US011845628B2

(12) United States Patent
Kii

(10) Patent No.: US 11,845,628 B2
(45) Date of Patent: Dec. 19, 2023

(54) DRIVE TRANSFERRING DEVICE AND LIQUID EJECTING APPARATUS

(71) Applicant: SEIKO EPSON CORPORATION, Tokyo (JP)

(72) Inventor: Soichiro Kii, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 179 days.

(21) Appl. No.: 17/451,443

(22) Filed: Oct. 19, 2021

(65) Prior Publication Data

US 2022/0119213 A1 Apr. 21, 2022

(30) Foreign Application Priority Data

Oct. 21, 2020 (JP) ..... 2020-176784

(51) Int. Cl.
*B65H 5/06* (2006.01)
*B41J 13/00* (2006.01)

(52) U.S. Cl.
CPC ..... *B65H 5/062* (2013.01); *B41J 13/009* (2013.01); *B65H 2301/341* (2013.01); *B65H 2403/40* (2013.01); *B65H 2403/72* (2013.01); *B65H 2403/724* (2013.01)

(58) Field of Classification Search
CPC ..... B65H 2301/341
See application file for complete search history.

(56) References Cited

U.S. PATENT DOCUMENTS

2015/0090563 A1* 4/2015 Uesugi ..... B41J 29/38 198/791
2015/0274477 A1 10/2015 Kodama
2016/0137443 A1* 5/2016 Azeta ..... B65H 3/06 271/225
2020/0039255 A1 2/2020 Kozuma et al.

FOREIGN PATENT DOCUMENTS

JP H06-161184 A 6/1994
JP 2006-111390 A 4/2006
JP 2009-067503 A 4/2009
JP 2017-137143 A 8/2017
JP 2019-081659 A 5/2019

* cited by examiner

*Primary Examiner* — Jennifer Bahls
(74) *Attorney, Agent, or Firm* — WORKMAN NYDEGGER

(57) ABSTRACT

A drive transferring unit includes a first roller, a second roller, a first clutch, a second clutch, a transferring section, and a control section. The first roller includes a first shaft section. The second roller includes a second shaft section. The first clutch switches between enabling transfer of a driving force to the first shaft section and interrupting transfer thereof. The second clutch switches between enabling transfer of the driving force to the second shaft section and interrupting transfer thereof. The transferring section transfers the driving force from one of the first roller and the second roller to the other. The control section selects between first control in which the first clutch is in the on state and the second clutch is in the off state and second control in which the second clutch is in the on state and the first clutch is in the off state.

20 Claims, 21 Drawing Sheets

DRIVE TRANSFERRING DEVICE AND LIQUID EJECTING APPARATUS

The present application is based on, and claims priority from JP Application Serial Number 2020-176784, filed Oct. 21, 2020, the disclosure of which is hereby incorporated by reference herein in its entirety.

BACKGROUND

1. Technical Field

The present disclosure relates to a drive transferring device and a liquid ejecting apparatus.

2. Related Art

A recording apparatus according to JP-A-2019-81659 includes a switchback path on which a recording sheet is switched back and transported in reverse, a plurality of transport rollers, and a plurality of driven rollers.

In a configuration in which a plurality of rollers rotate as in the recording apparatus according to JP-A-2019-81659, when two or more motors are used to change the rotational states of the rollers, a drive transferring device may have a complex structure.

SUMMARY

To address the aforementioned problem, a drive transferring device according to the disclosure includes: a first roller that includes a first shaft section extending in one direction and transports a medium; a second roller that is arranged at a position different from that of the first roller, includes a second shaft section extending in the one direction, and transports the medium; a first switching section that is provided on a first transferring path for transferring a driving force from a drive source to the first shaft section and that is configured to switch between enabling transfer of the driving force and interrupting transfer of the driving force; a second switching section that is provided on a second transferring path for transferring the driving force from the drive source to the second shaft section and that is configured to switch between enabling transfer of the driving force and interrupting transfer of the driving force; a transferring section that transfers the driving force from one of the first roller and the second roller to the other; and a control section that is configured to select between first control in which the first switching section enables transfer of the driving force and the second switching section interrupts transfer of the driving force and second control in which the second switching section enables transfer of the driving force and the first switching section interrupts transfer of the driving force.

DESCRIPTION OF EXEMPLARY EMBODIMENTS

Figure 1:
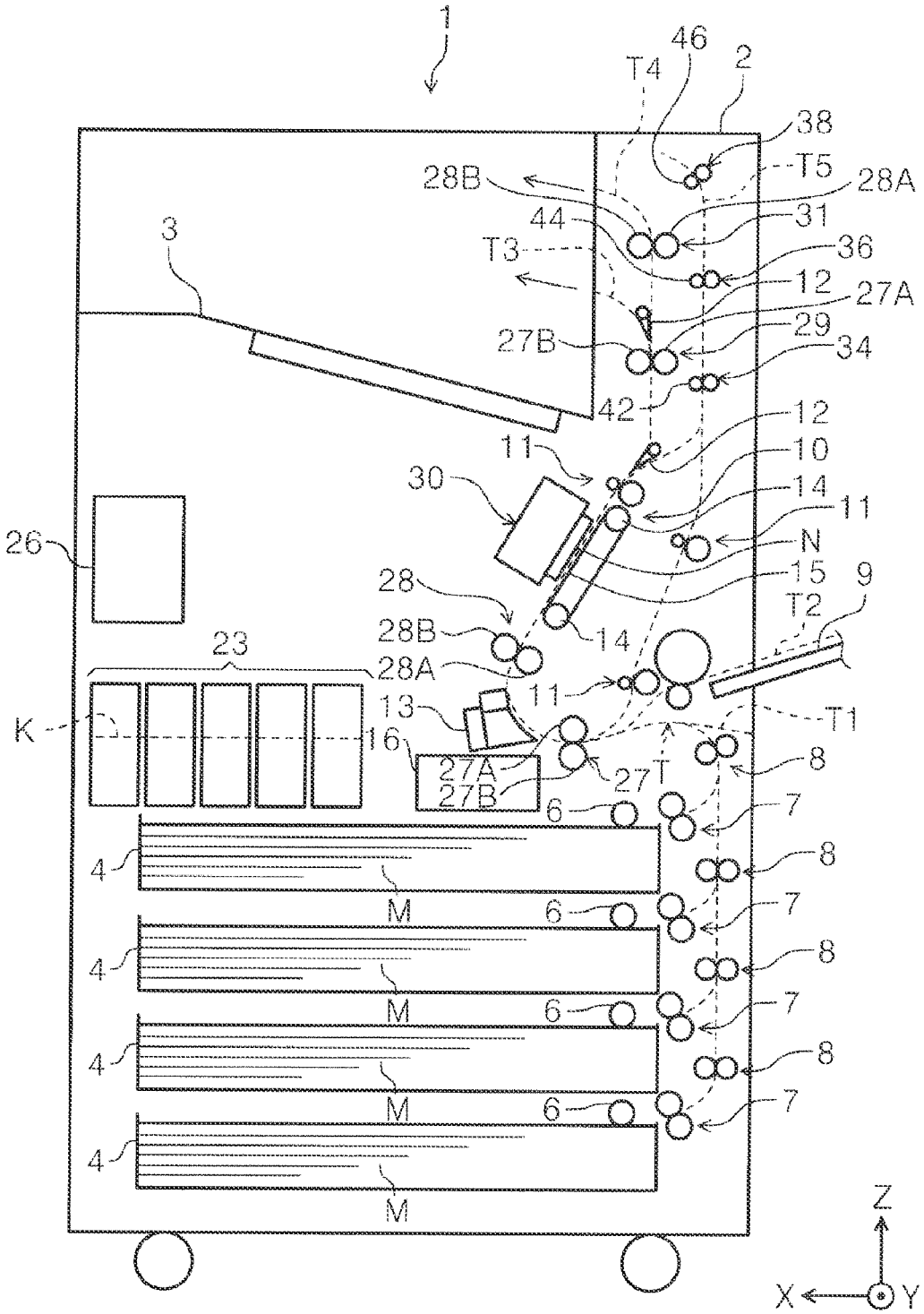
FIG. 1 illustrates a transport path of a sheet in a printer according to Embodiment 1.

Hereinafter, the disclosure will be schematically described.

A drive transferring device of a first aspect includes: a first roller that includes a first shaft section extending in one direction and transports a medium; a second roller that is arranged at a position different from that of the first roller, includes a second shaft section extending in the one direction, and transports the medium; a first switching section that is provided on a first transferring path for transferring a driving force from a drive source to the first shaft section and that is configured to switch between enabling transfer of the driving force and interrupting transfer of the driving force; a second switching section that is provided on a second transferring path for transferring the driving force from the drive source to the second shaft section and that is configured to switch between enabling transfer of the driving force and interrupting transfer of the driving force; a transferring section that transfers the driving force from one of the first roller and the second roller to the other; and a control section that is configured to select between first control in which the first switching section enables transfer of the driving force and the second switching section interrupts transfer of the driving force and second control in which the second switching section enables transfer of the driving force and the first switching section interrupts transfer of the driving force.

According to the present aspect, when the control section selects the first control, the first switching section enables transfer of the driving force, and the second switching section interrupts transfer of the driving force. The first roller thus rotates. Further, the driving force when the first roller rotates is transferred to the second roller by the transferring section. Here, since the second switching section interrupts transfer of the driving force, the second roller rotates with the driving force transferred by the transferring section.

On the other hand, when the control section selects the second control, the second switching section enables transfer of the driving force and the first switching section interrupts transfer of the driving force, and the second roller thus rotates. Further, the driving force when the second roller rotates is transferred to the first roller by the transferring section. Here, since the first switching section interrupts transfer of the driving force, the first roller rotates with the driving force transferred by the transferring section.

In this manner, even when the single driving force is provided, it is possible to change the rotational states of the first roller and the second roller by selecting the first control or the second control. For example, in an instance in which the rotational direction of the first roller when the first switching section is used differs from the rotational direction of the second roller when the second switching section is used, the first roller and the second roller rotate in a forward or reverse direction, thus making it possible to switch driving of the first roller and the second roller by using a simple configuration.

Alternatively, in an instance in which the rotational speed of the first roller when the first switching section is used differs from the rotational speed of the second roller when the second switching section is used, the rotational speed of the first roller and the rotational speed of the second roller are switched, thus making it possible to switch the rotational speed of the first roller and the rotational speed of the second roller by using a simple configuration.

According to the drive transferring device of a second aspect, in the first aspect, the transferring section transfers the driving force from the first transferring path to the second transferring path in the first control and transfers the driving force from the second transferring path to the first transferring path in the second control.

According to the present aspect, since the single transferring section functions in the first control and the second control, it is possible to switch driving of the first roller and the second roller by using a simple configuration.

According to the drive transferring device of a third aspect, in the first or second aspect, the transferring section transfers the driving force from the first shaft section to the second shaft section in the first control and transfers the driving force from the second shaft section to the first shaft section in the second control.

According to the present aspect, since the single transferring section functions in the first control and the second control, it is possible to switch driving of the first roller and the second roller by using a simple configuration.

According to the drive transferring device of a fourth aspect, in any one of the first to third aspects, the transferring section transfers the driving force such that the first shaft section starts to rotate and the second shaft section then starts to rotate in the first control, and transfers the driving force such that the second shaft section starts to rotate and the first shaft section then starts to rotate in the second control.

According to the present aspect, since the single transferring section functions in the first control and the second control, it is possible to switch driving of the first roller and the second roller by using a simple configuration.

According to the drive transferring device of a fifth aspect, in any one of the first to fourth aspects, the first switching section includes a first rotating body and a second rotating body that have a common central axis corresponding to a first virtual line extending in the one direction, and the second switching section includes a third rotating body and a fourth rotating body that have a common central axis corresponding to a second virtual line extending in the one direction.

According to the present aspect, since the first rotating body and the second rotating body have the common central axis corresponding to the first virtual line and the third rotating body and the fourth rotating body have the common central axis corresponding to the second virtual line, an installation space of the second transferring path is reduced compared with a configuration in which components from the first rotating body to the fourth rotating body are separately arranged, thus making it possible to reduce the size of the drive transferring device.

According to the drive transferring device of a sixth aspect, in the fifth aspect, the first rotating body constitutes a portion of the second transferring path in the second control.

According to the present aspect, it is possible to reduce the number of components required to form the second transferring path compared with a configuration in which another rotating body is used instead of the first rotating body to constitute a portion of the second transferring path.

According to the drive transferring device of a seventh aspect, in any one of the first to sixth aspects, when control is switched from one of the first control and the second control to the other, the first roller and the second roller change a rotational direction.

According to the present aspect, when the control section selects the second control while the first control is performed or selects the first control while the second control is performed, the rotational directions of the first roller and the second roller are switched, thus making it possible to switch the rotational directions of the first roller and the second roller by using a simple configuration.

According to the drive transferring device of an eighth aspect, in any one of the first to seventh aspects, when control is switched from one of the first control and the second control to the other, the first roller and the second roller change rotational speed.

According to the present aspect, when the control section selects the second control while the first control is performed or selects the first control while the second control is performed, the rotational speed of the first roller and the rotational speed of the second roller are switched, thus making it possible to switch the rotational speed of the first roller and the rotational speed of the second roller by using a simple configuration.

According to the drive transferring device of a ninth aspect, in any one of the first to eighth aspects, the transferring section enables the first roller and the second roller to rotate in an identical direction.

According to the present aspect, since the rotational direction of the first roller matches the rotational direction of the second roller, the first roller and the second roller are able to be arranged on the same transport path. Note that, at this time, the rotational speed of the first roller may be the same as or differ from the rotational speed of the second roller. When the rotational speed of the first roller and the rotational speed of the second roller for transporting a single medium are the same, the single medium is readily transported without a posture change. Moreover, when the rotational speed of the first roller and the rotational speed of the second roller for transporting a single medium differ from each other, tension is readily applied to the single medium, or the single medium readily warps. When tension is applied to the medium, the drive transferring device is usable to correct curling of the medium. When the medium is caused to warp, the drive transferring device is usable to correct skewing of the medium.

According to the drive transferring device of a tenth aspect, in any one of the first to eighth aspects, the transferring section enables the first roller and the second roller to rotate in different directions.

According to the present aspect, since the rotational direction of the first roller differs from the rotational direction of the second roller, the first roller and the second roller are usable for different purposes.

For example, the first roller and the second roller may transport the medium while holding the medium therebetween, or a process of folding the medium may be performed. Moreover, for example, the first roller and the second roller may be arranged with the transport path interposed therebetween such that the rollers may act on the medium in different directions. Note that, at this time, the rotational speed of the first roller may be the same as or differ from the rotational speed of the second roller. When the rotational speed of the first roller and the rotational speed of the second roller for transporting the medium are the same, the medium is readily transported without a posture change. Moreover, when the rotational speed of the first roller and the rotational speed of the second roller for transporting the medium differ from each other, multi-feeding of media is easily prevented.

According to the drive transferring device of an eleventh aspect, in any one of the first to tenth aspects, the first switching section and the second switching section are located on one side with respect to the first roller and the second roller in the one direction, and the transferring section of any one of the first to tenth aspects is located on the other side with respect to the first roller and the second roller in the one direction.

According to the present aspect, the configuration for transferring the driving force is not arranged significantly near to one side with respect to the first roller and the second roller, thus easily securing a space in which the transferring section is arranged.

According to the drive transferring device of a twelfth aspect, in any one of the first to eleventh aspects, the control section causes the first switching section and the second switching section to interrupt transfer of the driving force between the first control and the second control.

According to the present aspect, when the control is switched from one of the first control and the second control to the other, the first switching section and the second switching section interrupt transfer of the driving force during a time between the first control and the second control, thus making it possible to prevent one of the switching sections from transferring the driving force in a state in which the other incompletely interrupts transfer of the driving force.

According to the drive transferring device of a thirteenth aspect, in any one of the first to twelfth aspects, the transferring section includes a time-difference calculating section that causes a time point at which the first shaft section or the second shaft section starts to rotate to be delayed relative to a time point at which the driving force is transferred.

According to the present aspect, even when the control section instantaneously switches the control from one of the first control and the second control to the other, the time-difference calculating section causes the time point at which the first shaft section or the second shaft section starts to rotate to be delayed relative to the time point at which the driving force is transferred, thus making it possible to prevent one of the switching sections from transferring the driving force in a state in which the other incompletely interrupts transfer of the driving force.

According to the drive transferring device of a fourteenth aspect, in any one of the first to thirteenth aspects, the control section switches control from one of the first control and the second control to the other during operation of the drive source.

According to the present aspect, it is not necessary to stop the operation of the drive source, thus making it possible to suppress elongation of a time period in which the first roller and the second roller transport the medium.

According to the drive transferring device of a fifteenth aspect, in any one of the first to fourteenth aspects, the drive source transfers the driving force to the first transferring path and the second transferring path via a rotating section that rotates in only one direction.

According to the present aspect, since the rotating section rotates in only one direction, it is possible to transport the medium without using the drive source capable of rotating in forward and reverse directions.

According to the drive transferring device of a sixteenth aspect, in any one of the first to fifteenth aspects, the first roller and the second roller are provided on a switchback path for switching a transport direction of the medium.

According to the present aspect, since the transport direction of the medium is switched by the first roller and the second roller on the switchback path, it is possible to set a dimension of the switchback path to be long compared with a configuration in which only a single roller is used on the switchback path.

According to the drive transferring device of a seventeenth aspect, in any one of the first to sixteenth aspects, the first switching section performs switching to either enabling transfer of the driving force or interrupting transfer of the driving force in a radial direction of the first shaft section.

According to the present aspect, the switching operation is performed in the radial direction of the first shaft section. In other words, no switching operation is performed in the axial direction of the first shaft section. Accordingly, it is not necessary to secure a space for the switching operation of the first switching section in the axial direction of the first shaft section, thus making it possible to enhance flexibility in arranging the first switching section in the axial direction.

According to the drive transferring device of an eighteenth aspect, in any one of the first to seventeenth aspects, the first switching section is arranged on the first shaft section.

According to the present aspect, it is possible to enable transfer of the driving force or interrupt transfer of the driving force on the first shaft section, thus making it possible to shorten time required to switch the control from one of the first control and the second control to the other compared with a configuration in which the first switching section is not arranged on the first shaft section.

In any one of the first to eighteenth aspects, the drive transferring device of a nineteenth aspect further includes a third roller that includes a third shaft section extending in the one direction and receives the driving force from the transferring section to transport the medium.

According to the present aspect, it is possible to provide the third roller and control rotation of the third roller without affecting the configurations of the first transferring path and the second transferring path.

In the nineteenth aspect, the drive transferring device of a twentieth aspect further includes a third switching section that is provided on a third transferring path for transferring the driving force from the transferring section to the third shaft section and that is configured to switch between enabling transfer of the driving force and interrupting transfer of the driving force, in which the control section causes any one of the first switching section, the second switching section, and the third switching section to transfer the driving force and causes the other two switching sections to interrupt transfer of the driving force.

According to the present aspect, since any one of the first switching section, the second switching section, and the third switching section is in the state of enabling transfer of the driving force, it is possible to switch the rotational states of the first roller, the second roller, and the third roller.

In any one of the first to twentieth aspects, the drive transferring device of a twenty-first aspect further includes: a first driven roller that nips the medium with the first roller and is rotated upon rotation of the first roller; and a second driven roller that nips the medium with the second roller and is rotated upon rotation of the second roller.

According to the present aspect, in a state in which the medium does not exist, the first roller and the first driven roller form a nip, and the second roller and the second driven roller form a nip. In this manner, since a plurality of nips are formed, it is possible to disperse a nip force acting on the medium.

A liquid ejecting apparatus according to a twenty-second aspect includes: a recording section that performs recording by ejecting a liquid onto the medium; and the drive transferring device according to any one of the first to twenty-first aspects that transfers the driving force to the first roller and the second roller to transport the medium subjected to recording by the recording section.

According to the present aspect, it is possible to exhibit an operational effect similar to that of the drive transferring device according to any one of the first to twentieth aspects.

Embodiment 1

A drive transferring unit 50 and a printer 1 according to Embodiment 1, which are respective examples of the drive transferring device and the liquid ejecting apparatus according to the disclosure, will be specifically described below.

As illustrated in FIG. 1, the printer 1 is configured as an ink jet apparatus that performs recording on a medium M such as a recording sheet by ejecting ink K, which is an example of the liquid. Note that the X-Y-Z coordinate system illustrated in each drawing is an orthogonal coordinate system.

The X direction is an apparatus width direction when viewed from an operator of the printer 1 and is a horizontal direction. In the X direction, a leftward direction is the +X direction, and a rightward direction is the −X direction.

The Y direction is a width direction of the medium M, which intersects a transport direction of the medium M, an apparatus depth direction, and a horizontal direction. The Y direction is an example of the one direction. In the Y direction, a frontward direction is the +Y direction, and a rearward direction is the −Y direction.

The Z direction is an apparatus height direction and, for example, the vertical direction. In the Z direction, an upward direction is the +Z direction, and a downward direction is the −Z direction.

The printer 1 includes a line head 30 described later and the drive transferring unit 50. Specifically, the printer 1 includes an apparatus main body 2. The apparatus main body 2 includes a housing serving as a casing. A discharge section 3 having a space to which a recorded medium M is discharged is formed in the +Z direction with respect to the center of the apparatus main body 2 in the Z direction. Moreover, a plurality of media cassettes 4 are provided in the apparatus main body 2.

Media M are stored in the plurality of media cassettes 4. The medium M stored in the media cassettes 4 is transported on a transport path T by a pick-up roller 6 and pairs of transport rollers 7 and 8. A transport path T1 on which the medium M is transported from an external apparatus and a transport path T2 on which the medium M is transported from a manual tray 9 provided in the apparatus main body 2 merge on the transport path T.

A transport unit 10 for transporting the medium M, pairs of transport rollers 11, 27, 28, 29, and 31, a plurality of flaps 12 for switching a path on which the medium M is transported, and a medium-width sensor 13 for detecting a width of the medium M in the Y direction are arranged on the transport path T.

The transport unit 10 includes two pulleys 14, an endless transport belt 15 wound around the two pulleys 14, and a motor (not illustrated) that drives one of the pulleys 14. The medium M is transported at a position facing the line head 30 described later while the medium M clings to a belt surface of the transport belt 15.

A transport path T3 and a transport path T4 toward the discharge section 3 and an inverting path T5 on which the front and back of the medium M are inverted are provided downstream of the transport unit 10 on the transport path T.

The inverting path T5 is an example of the switchback path and is also a path on which the transport direction of the medium M is switched.

The pair of transport rollers 27 is arranged upstream of the medium-width sensor 13 on the transport path T. The pair of transport rollers 28 is arranged between the medium-width sensor 13 and the line head 30 described later.

The pair of transport rollers 29 is arranged upstream of a branch point at which the transport path T branches to the transport path T3 and the transport path T4. The pair of transport rollers 31 is arranged on the transport path T4.

The pairs of transport rollers 27 and 29 are each constituted by a roller 27A and a roller 27B. The pairs of transport rollers 28 and 31 are each constituted by a roller 28A and a roller 28B.

The roller 27A and the roller 28A are each provided to be rotatable about a rotational axis extending in the Y direction. The rollers 27A and 28A come into contact with the back of the medium M. That is, the roller 27A and the roller 28A rotate in the same direction when viewed in the Y direction. The roller 27A and the roller 27B hold the medium M therebetween to transport the medium M upon rotation. The roller 28A and the roller 28B hold the medium M therebetween to transport the medium M upon rotation.

For example, a plurality of pairs of rollers including a pair of a first roller 34 and an opposed roller 42, a pair of a second roller 36 and an opposed roller 44, and a pair of a third roller 38 and an opposed roller 46 are provided on the inverting path T5.

The recorded medium M enters the inverting path T5 from the transport path T, is transported in the +Z direction, and is stopped. The medium M is then switched back to reenter the transport path T from an upstream portion of the medium-width sensor 13 and has the front and back inverted.

An ink container 23 that stores the ink K, a waste-liquid accumulation section 16 that accumulates waste liquid of the ink K, a control section 26 that controls operation of the respective sections of the printer 1, and a motor 51 (FIG. 2), which is an example of the drive source, are provided in the apparatus main body 2.

The ink container 23 supplies the ink K to the line head 30 described later.

The control section 26 includes a central processing unit (CPU), read-only memory (ROM), random access memory (RAM), and storage, which are not illustrated, and controls transportation of the medium M in the printer 1 and operation of the respective sections including the line head 30 and the drive transferring unit 50 (FIG. 2) described later. Note that the control section 26 is an example of a control section of the drive transferring unit 50. The control section 26 controls a first clutch 57, a second clutch 65, and a third clutch 126 described later to enable transfer of a driving force F or interrupt transfer of the driving force F.

Figure 2:
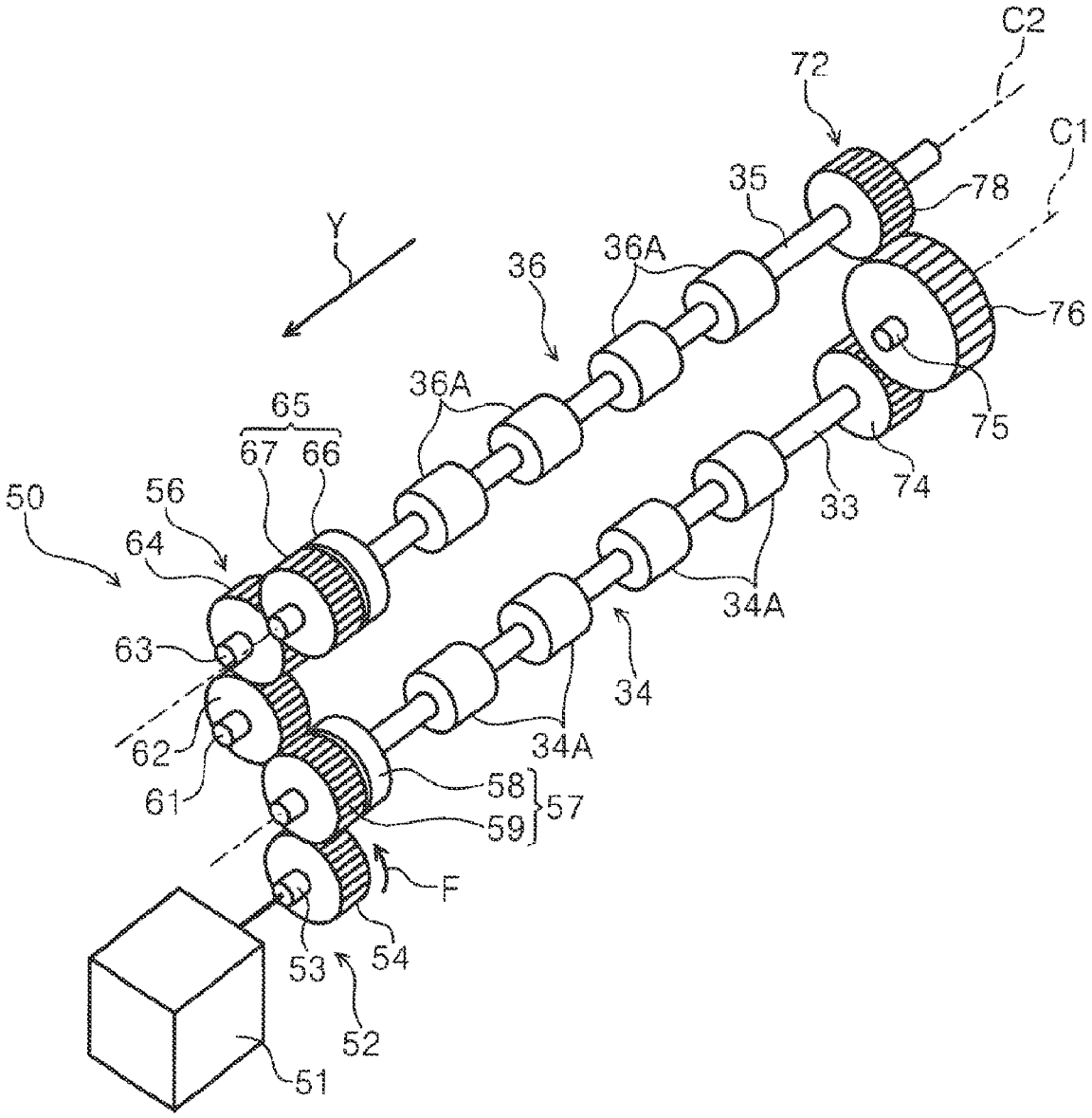
FIG. 2 is a perspective view illustrating a drive transferring unit, a first roller, and a second roller according to Embodiment 1.

As illustrated in FIG. 2, the motor 51 applies the driving force F to the drive transferring unit 50. Specifically, the motor 51 rotates a drive shaft 53 of a drive gear 54. The drive gear 54 is an example of the rotating section. The drive shaft 53 is arranged in the Y direction. In the present embodiment, the drive gear 54 rotates counterclockwise, for example, when viewed in the −Y direction from the position of the motor 51. In this manner, the motor 51 performs rotational drive in one direction.

The motor 51 transfers the driving force F to a first transferring path 52 and a second transferring path 56 described later via the drive gear 54 that rotates in only one direction.

In the following description, a rotational direction of a member will be described by assuming that the counterclockwise direction is the direction −R and the clockwise direction is the direction +R when viewed in the −Y direction from the position of the motor 51.

As illustrated in FIG. 1, the line head 30 is an example of the recording section for performing recording by ejecting the ink K onto the medium M and is provided in the apparatus main body 2. The line head 30 includes a nozzle section N constituted by a plurality of nozzles for ejecting the ink K. In this manner, the line head 30 is configured as an ink ejecting head capable of performing recording on the entire region of the medium M in the Y direction without the medium M moving in the Y direction.

The drive transferring unit 50 illustrated in FIG. 2 is an example of the drive transferring device and transfers the driving force to the first roller 34 or the second roller 36 to transport the medium M subjected to recording by the line head 30.

The drive transferring unit 50 includes the first roller 34, the second roller 36, the first clutch 57, the second clutch 65, a transferring section 72, and the control section 26 (FIG. 1).

The first roller 34 includes, for example, a first shaft section 33 extending in the Y direction and four rubber sections 34A and transports the medium M. The first shaft section 33 has a column shape whose central axis extends in the Y direction. Each end of the first shaft section 33 in the Y direction is rotatably supported by a main body frame (not illustrated) via a bearing. The four rubber sections 34A each have a cylindrical shape and are attached to the first shaft section 33.

The second roller 36 is arranged at a position different from that of the first roller 34. In the present embodiment, the second roller 36 is arranged, for example, in the +Z direction with respect to the first roller 34. Moreover, the second roller 36 includes, for example, a second shaft section 35 extending in the Y direction and four rubber sections 36A and transports the medium M. The second shaft section 35 has a column shape whose central axis extends in the Y direction. Each end of the second shaft section 35 in the Y direction is rotatably supported by the main body frame (not illustrated) via a bearing. The four rubber sections 36A each have a cylindrical shape and are attached to the second shaft section 35.

The opposed roller 42 is an example of the first driven roller, nips the medium M with the first roller 34, and rotates upon rotation of the first roller 34.

The opposed roller 44, which is an example of the second driven roller, nips the medium M with the second roller 36 and rotates upon rotation of the second roller 36.

The first clutch 57, which is an example of the first switching section, is provided on the first transferring path 52 and configured to be able to switch between enabling transfer of the driving force F and interrupting transfer of the driving force F. The on state is a state in which the driving force is transferred, and the off state is a state in which transfer of the driving force is interrupted. Specifically, the first clutch 57 is configured as an electromagnetic clutch and includes a main body section 58 and a clutch gear 59.

The main body section 58 is an example of the second rotating body. Moreover, the main body section 58 includes therein a coil (not illustrated) and generates a magnetic force when energized by a power supply of the printer 1. Moreover, the main body section 58 is integrated with the first shaft section 33. The end of the first shaft section 33 in the +Y direction is inserted into a through hole of the clutch gear 59. In this manner, the first clutch 57 is arranged on the first shaft section 33.

The clutch gear 59 includes a metal plate (not illustrated). A tooth section of the clutch gear 59 engages a tooth section of the drive gear 54. The clutch gear 59 is an example of the first rotating body. A first virtual line C1 extending in the Y direction denotes the common central axis of the main body section 58 and the clutch gear 59. The clutch gear 59 constitutes a portion of the second transferring path 56 described later in second control described later.

When the first clutch 57 does not enable the main body section 58 to be energized, the clutch gear 59 does not move in conjunction with the main body section 58 and is rotatable alone about the first shaft section 33.

When the first clutch 57 enables the main body section 58 to be energized, the main body section 58 attracts the metal plate of the clutch gear 59 with a magnetic force, and the clutch gear 59 is thereby integrated with the main body section 58 and rotates upon rotation of the first shaft section 33.

The second clutch 65, which is an example of the second switching section, is provided on the second transferring path 56 and is configured to be able to switch between enabling transfer of the driving force F and interrupting transfer of the driving force F. The on state is a state in which the driving force is transferred, and the off state is a state in which transfer of the driving force F is interrupted. Specifically, the second clutch 65 is configured as an electromagnetic clutch and includes a main body section 66 and a clutch gear 67.

The main body section 66 is an example of the fourth rotating body. Moreover, the main body section 66 includes therein a coil (not illustrated) and generates a magnetic force when energized by the power supply of the printer 1. Moreover, the main body section 66 is integrated with the second shaft section 35. The end of the second shaft section 35 in the +Y direction is inserted into a through hole of the clutch gear 67.

The first clutch 57 and the second clutch 65 are located in the +Y direction, that is, on one side with respect to the first roller 34 and the second roller 36 in the Y direction.

The clutch gear 67 includes a metal plate (not illustrated). A tooth section of the clutch gear 67 engages a tooth section of an idler gear 64 described later. The clutch gear 67 is an example of the third rotating body. A second virtual line C2 extending in the Y direction denotes the common central axis of the main body section 66 and the clutch gear 67.

When the second clutch 65 does not enable the main body section 66 to be energized, the clutch gear 67 does not move in conjunction with the main body section 66 and is rotatable alone about the second shaft section 35.

When the second clutch 65 enables the main body section 66 to be energized, the main body section 66 attracts the metal plate of the clutch gear 67 with a magnetic force, and the clutch gear 67 is thereby integrated with the main body section 66 and rotates upon rotation of the second shaft section 35.

The first transferring path 52 is a path for transferring the driving force from the motor 51 to the first shaft section 33. The first transferring path 52 is constituted by, for example, the drive gear 54 and the first clutch 57.

The second transferring path 56 is a path for transferring the driving force from the motor 51 to the second shaft section 35. The second transferring path 56 is constituted by, for example, the drive gear 54, the first clutch 57, an idler gear 62, the idler gear 64, and the second clutch 65.

The idler gear 62 is provided to be rotatable about a shaft section 61 extending in the Y direction. A tooth section of the idler gear 62 engages the tooth section of the clutch gear 59.

The idler gear 64 is provided to be rotatable about a shaft section 63 extending in the Y direction. The tooth section of the idler gear 64 engages the tooth section of the idler gear 62 and the tooth section of the clutch gear 67.

The transferring section 72 is located in the −Y direction, that is, on the other side with respect to the first roller 34 and the second roller 36 in the Y direction. Moreover, the transferring section 72 transfers the driving force F from one of the first roller 34 and the second roller 36 to the other. In other words, the transferring section 72 transfers the driving force F from the first roller 34 to the second roller 36 or transfers the driving force F from the second roller 36 to the first roller 34. The transferring section 72 includes, for example, a transferring gear 74, an idler gear 76, and a transferring gear 78.

The end of the first shaft section 33 in the −Y direction is inserted into a through hole of the transferring gear 74.

The idler gear 76 is provided to be rotatable about a shaft section 75 extending in the Y direction. A tooth section of the idler gear 76 engages a tooth section of the transferring gear 74.

The end of the second shaft section 35 in the −Y direction is inserted into a through hole of the transferring gear 78. A tooth section of the transferring gear 78 engages the tooth section of the idler gear 76.

The transferring section 72 enables the first roller 34 and the second roller 36 to rotate in the same direction.

The outer diameters of the respective gears of the drive transferring unit 50 are set such that the first roller 34 and the second roller 36 rotate in the same rotational direction at substantially the same rotational speed.

The control section 26 illustrated in FIG. 1 is configured to be able to select between first control and second control in the drive transferring unit 50.

The first control is control in which the first clutch 57 enables transfer of the driving force F to the first roller 34 and in which the second clutch 65 interrupts transfer of the driving force F to the second roller 36. Specifically, the transferring section 72 transfers the driving force F from the first transferring path 52 to the second transferring path 56 in the first control. Moreover, the transferring section 72 transfers the driving force F from the first shaft section 33 to the second shaft section 35 in the first control.

The second control is control in which the second clutch 65 enables transfer of the driving force F to the second roller 36 and in which the first clutch 57 interrupts transfer of the driving force F to the first roller 34. Specifically, the transferring section 72 transfers the driving force from the second transferring path 56 to the first transferring path 52 in the second control. Moreover, the transferring section 72 transfers the driving force F from the second shaft section 35 to the first shaft section 33 in the second control.

Here, the first roller 34 and the second roller 36 change their rotational directions when the control is switched from one of the first control and the second control to the other.

Figure 5:
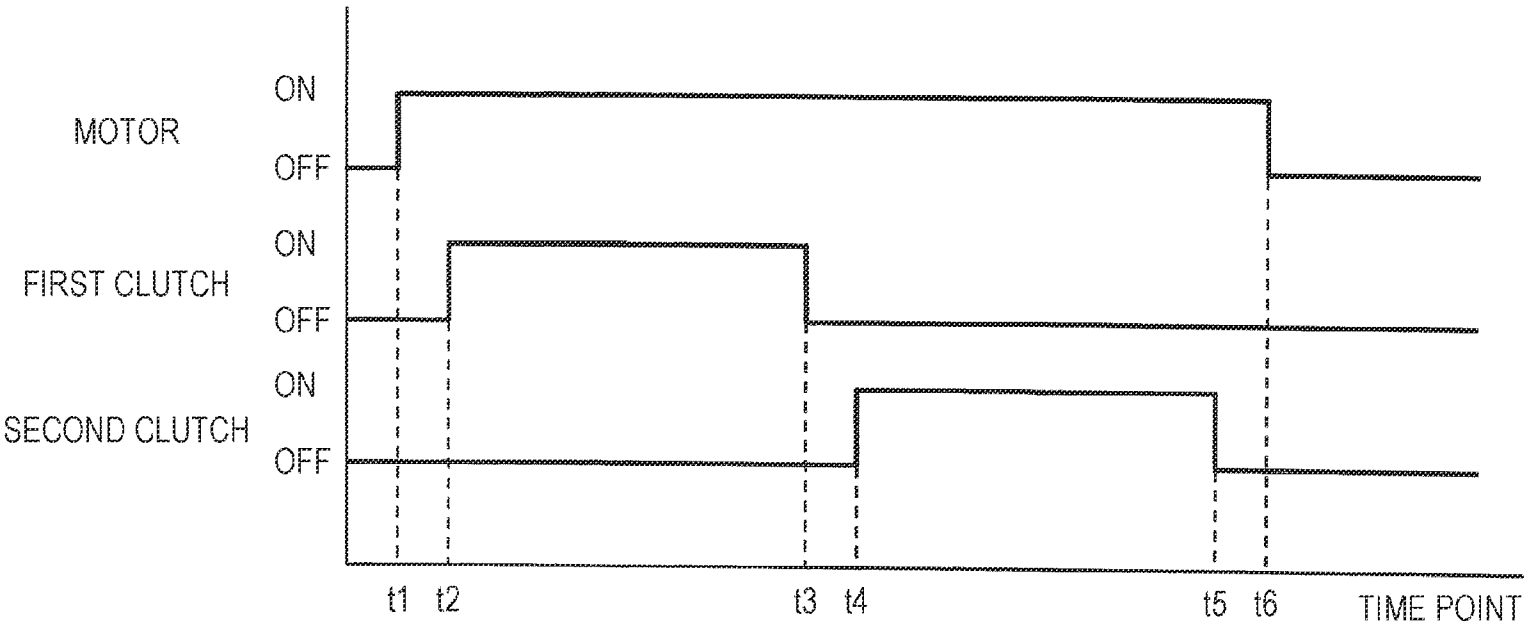
FIG. 5 is a timing chart illustrating on/off states of a motor, a first clutch, and a second clutch during the first control and second control in the drive transferring unit according to Embodiment 1.

As illustrated in FIGS. 2 and 5, the transferring section 72 transfers the driving force F such that the first shaft section 33 starts to rotate and the second shaft section 35 then starts to rotate in the first control. Further, the transferring section 72 transfers the driving force F such that the second shaft section 35 starts to rotate and the first shaft section 33 then starts to rotate in the second control after the first control.

The motor 51 is in the on state at a time point t1. The first clutch 57 is in the on state at a time point t2 and in the off state at a time point t3. The second clutch 65 is in the on state at a time point t4 and in the off state at a time point t5. The motor 51 is in an off state at a time point t6.

The control section 26 (FIG. 1) enables the first clutch 57 and the second clutch 65 to interrupt transfer of the driving force F between the first control and the second control. Specifically, both the first clutch 57 and the second clutch 65 are in the off state during a period from the time point t3 to the time point t4 in FIG. 5.

Figure 6:
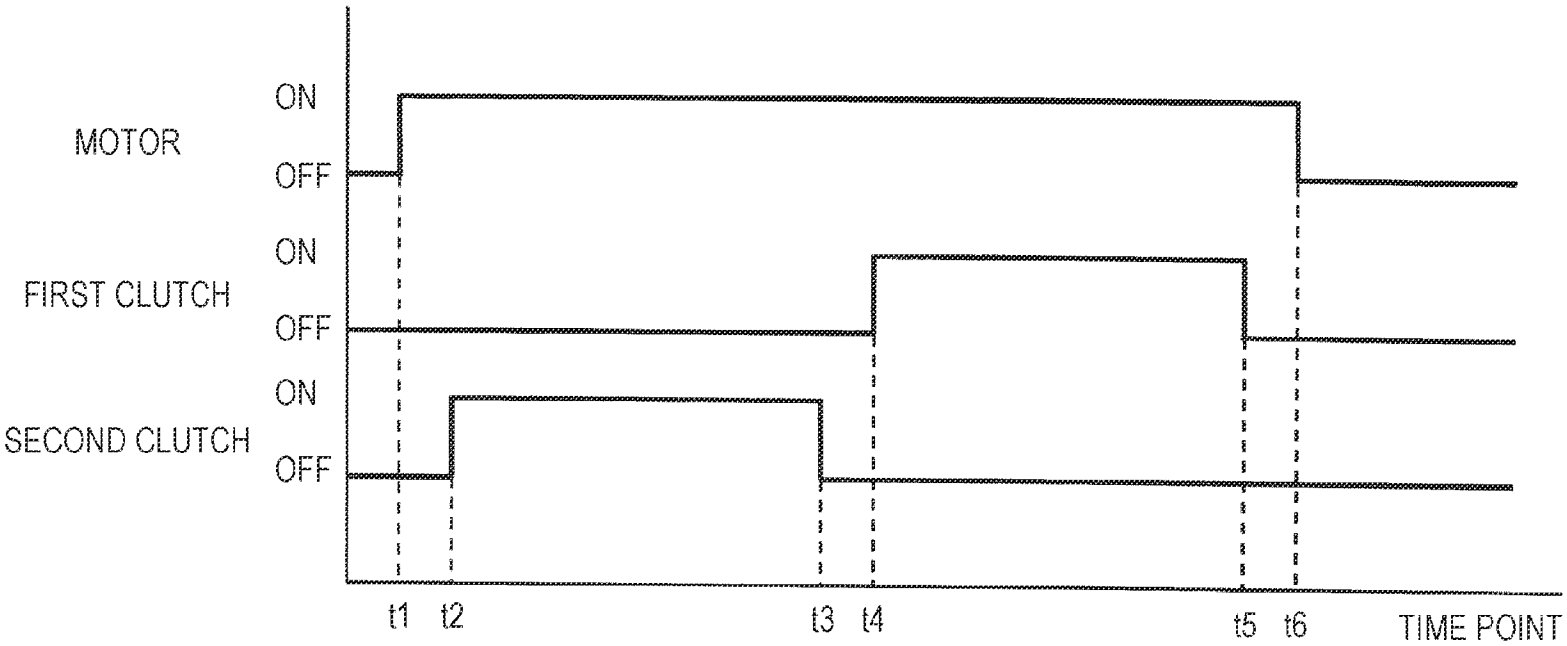
FIG. 6 is a timing chart illustrating on/off states of a motor, a first clutch, and a second clutch during control in a drive transferring unit according to a modified example of Embodiment 1.

FIG. 6 is a timing chart of the motor 51, the first clutch 57, and the second clutch 65 in a modified example of the drive transferring unit 50 of Embodiment 1. The transferring section 72 transfers the driving force F such that the second shaft section 35 starts to rotate and the first shaft section 33 then starts to rotate in the second control. Further, the transferring section 72 transfers the driving force F such that the first shaft section 33 starts to rotate and the second shaft section 35 then starts to rotate in the first control after the second control.

The motor 51 is in the on state at the time point t1. The second clutch 65 is in the on state at the time point t2 and in the off state at the time point t3. The first clutch 57 is in the on state at the time point t4 and in the off state at the time point t5. The motor 51 is in the off state at the time point t6.

Next, operation of the printer 1 and the drive transferring unit 50 according to Embodiment 1 will be described with reference to FIGS. 1 to 5. Note that description of drawings other than FIGS. 3 and 4 will be omitted.

Figure 3:
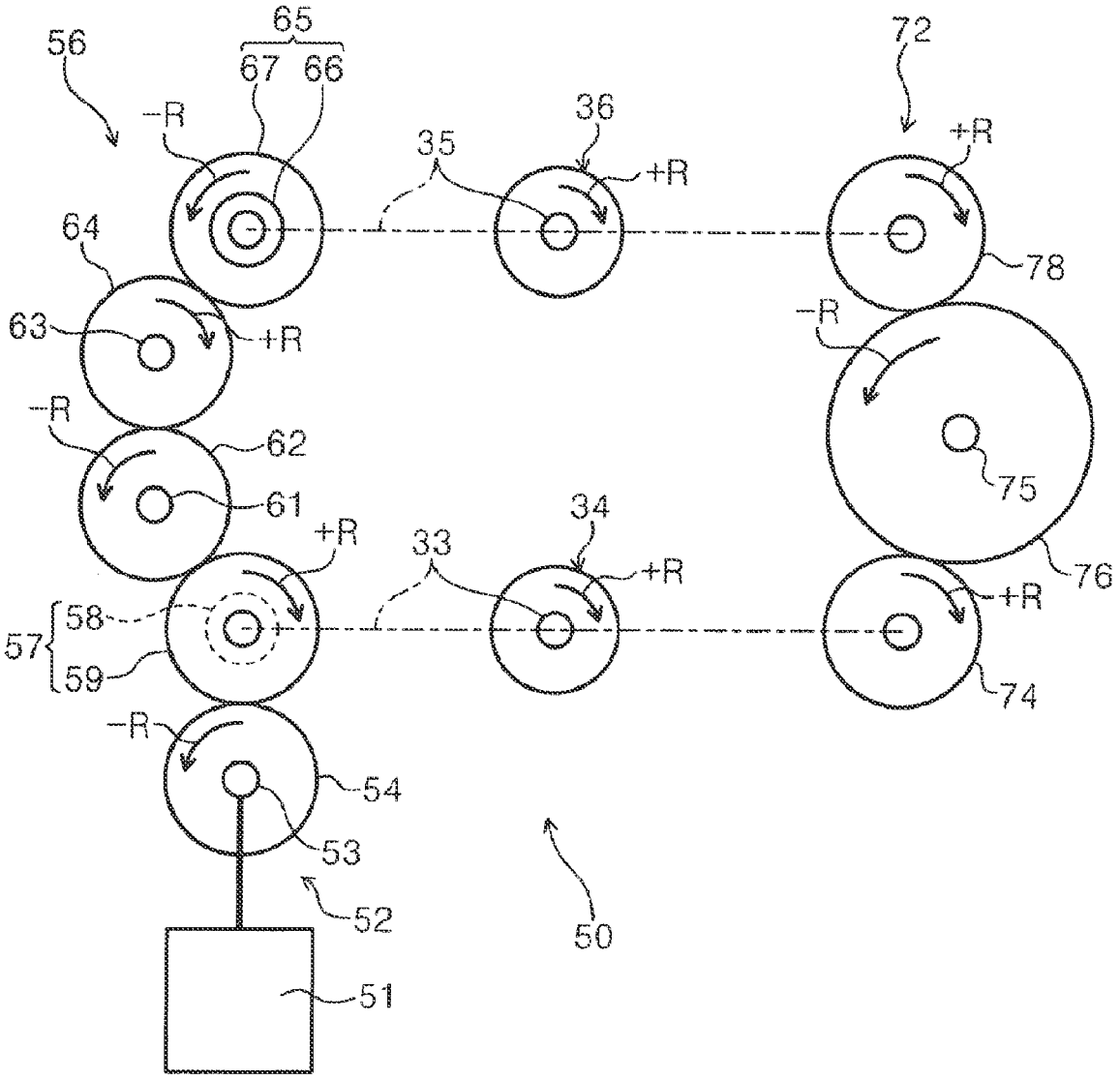
FIG. 3 is a schematic view illustrating rotational directions of gears, clutches, the first roller, and the second roller during first control in the drive transferring unit according to Embodiment 1.
Figure 4:
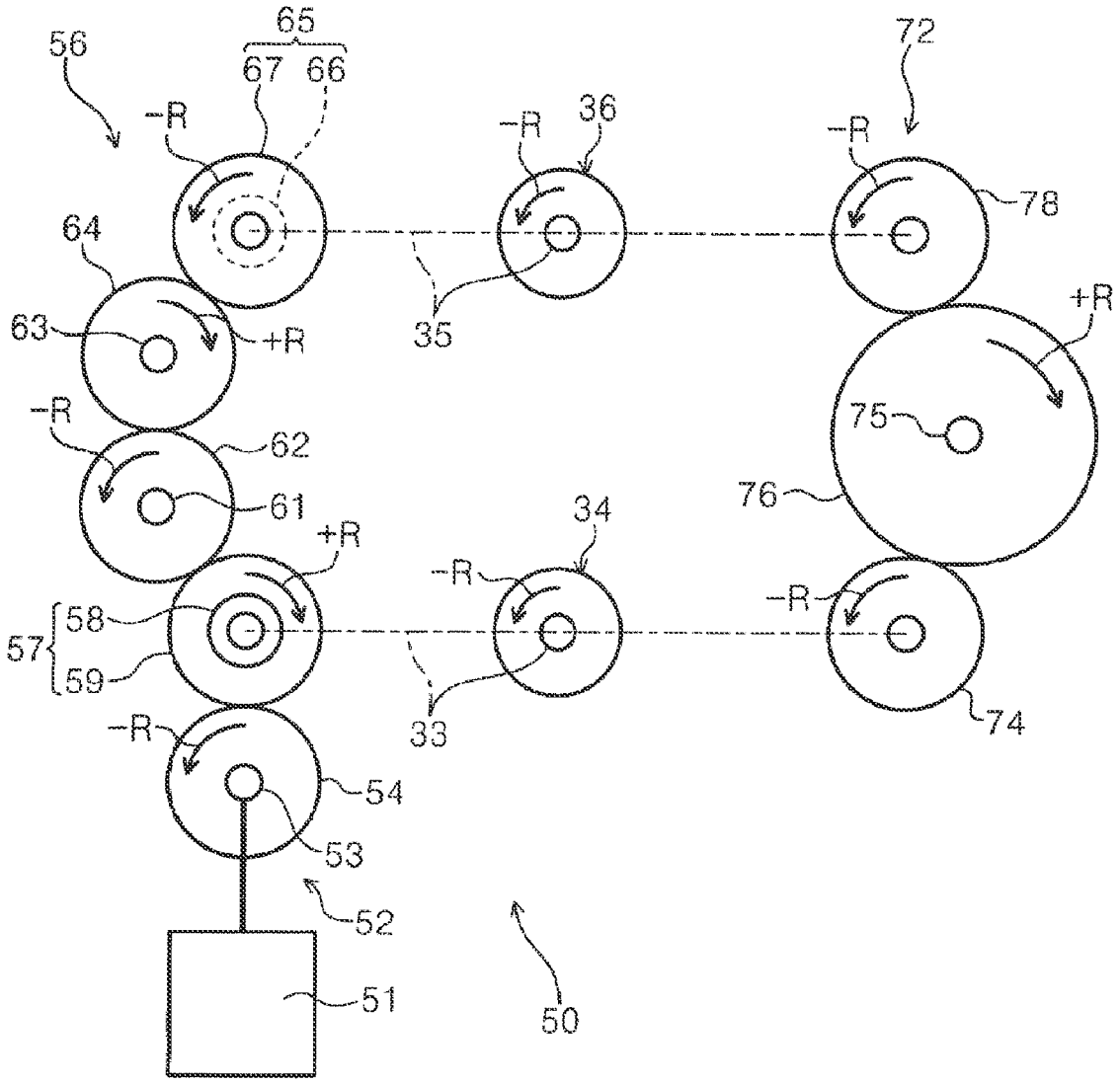
FIG. 4 is a schematic view illustrating rotational directions of the gears, the clutches, the first roller, and the second roller during second control in the drive transferring unit according to Embodiment 1.

FIGS. 3 and 4 illustrate a state in which the respective members constituting the first transferring path 52 and the second transferring path 56, the first roller 34, the second roller 36, and the respective members constituting the transferring section 72, which are viewed from the same side, are arranged side by side.

In the following description, the main body section 58 when the first clutch 57 is in the state of enabling transfer of the driving force is indicated by the broken line indicating a smaller diameter than that of the clutch gear 59. The main body section 58 when the first clutch 57 is in the state of interrupting transfer of the driving force is indicated by the solid line indicating a smaller diameter than that of the clutch gear 59.

The main body section 66 when the second clutch 65 is in the state of enabling transfer of the driving force is indicated by the broken line indicating a smaller diameter than that of the clutch gear 67. The main body section 66 when the second clutch 65 is in the state of interrupting transfer of the driving force is indicated by the solid line indicating a smaller diameter than that of the clutch gear 67.

In the following description, description of rotational directions of the idler gears 62, 64, and 76 will be omitted.

As illustrated in FIG. 3, when the drive gear 54 rotates in the direction −R while the first clutch 57 is in the state of enabling transfer of the driving force and the second clutch 65 is in the interrupting state, the clutch gear 59 rotates in the direction +R on the first transferring path 52. The first roller 34 and the transferring gear 74 thus rotate in the direction +R. When the transferring section 72 transfers the driving force, the transferring gear 78 and the second roller 36 rotate in the direction +R.

On the other hand, when the clutch gear 59 rotates in the direction +R, the clutch gear 67 rotates in the direction −R on the second transferring path 56. Here, although the main body section 66 rotates in the direction +R upon rotation of the second roller 36 in an integral manner, the second clutch 65 is in the interrupting state, and the main body section 66 and the clutch gear 67 thus rotate in opposite directions without interfering with each other.

In this manner, when the first clutch 57 is in the state of enabling transfer of the driving force and when the second clutch 65 is in the interrupting state, the transferring section 72 transfers the driving force from the first roller 34 to the second roller 36.

As illustrated in FIG. 4, when the drive gear 54 rotates in the direction −R while the first clutch 57 is in the state of interrupting transfer of the driving force F and the second clutch 65 is in the state of enabling transfer of the driving force, the clutch gear 59 rotates in the direction +R on the first transferring path 52. At this time, the main body section 58 does not rotate.

When the clutch gear 59 rotates in the direction +R, the clutch gear 67 rotates in the direction −R on the second transferring path 56. Here, since the second clutch 65 is in the state of enabling transfer of the driving force, the main body section 66 rotates in the direction −R, and the second roller 36 and the transferring gear 78 thus rotate in the direction −R. When the transferring section 72 transfers the driving force, the transferring gear 74 and the first roller 34 rotate in the direction −R.

Although the main body section 58 rotates in the direction −R upon rotation of the first roller 34 in an integral manner, the first clutch 57 is in the interrupting state, and the main body section 58 and the clutch gear 59 thus rotate in opposite directions without interfering with each other.

In this manner, when the first clutch 57 is in the interrupting state and when the second clutch 65 is in the state of enabling transfer of the driving force, the transferring section 72 transfers the driving force from the second roller 36 to the first roller 34.

When the recorded medium M is transported from the transport path T to the inverting path T5, the first roller 34 and the second roller 36 rotate in the direction +R, and the third roller 38 also rotates in the direction +R, thus transporting the medium on the inverting path T5 in the +Z direction.

Next, as described above, when the first roller 34 and the second roller 36 rotate in the direction −R and when the third roller 38 also rotates in the direction −R, the medium M is switched back on the inverting path T5. Accordingly, the medium M reenters the transport path T upstream of the line head 30 and is transported.

As described above, according to the drive transferring unit 50, when the control section 26 selects the first control, the first clutch 57 enables transfer of the driving force and the second clutch 65 interrupts transfer of the driving force F and the first roller 34 thus rotates. Further, the driving force when the first roller 34 rotates is transferred by the transferring section 72 to the second roller 36. Here, since the second clutch 65 interrupts transfer of the driving force F, the second roller 36 rotates with the driving force F transferred by the transferring section 72.

On the other hand, when the control section 26 selects the second control, the second clutch 65 enables transfer of the driving force and the first clutch 57 interrupts transfer of the driving force F, and the second roller 36 thus rotates. Further, the driving force when the second roller 36 rotates is transferred by the transferring section 72 to the first roller 34. Here, since the first clutch 57 interrupts transfer of the driving force F, the first roller 34 rotates with the driving force F transferred by the transferring section 72.

In this manner, even when a single motor 51 is provided, it is possible to switch the rotational states of the first roller 34 and the second roller 36 by selecting the first control or the second control. For example, in an instance in which the rotational direction of the first roller 34 when the first clutch 57 is used differs from the rotational direction of the second roller 36 when the second clutch 65 is used, the first roller 34 and the second roller 36 rotate in a forward or reverse direction, thus making it possible to switch driving of the first roller 34 and the second roller 36 by using a simple configuration.

Alternatively, in an instance in which the rotational speed of the first roller 34 when the first clutch 57 is used differs from the rotational speed of the second roller 36 when the second clutch 65 is used, the rotational speed of the first roller 34 and the rotational speed of the second roller 36 are switched, thus making it possible to switch the rotational speed of the first roller 34 and the rotational speed of the second roller 36 by using a simple configuration.

According to the drive transferring unit 50, since a single transferring section 72 functions in the first control and the second control, it is possible to switch driving of the first roller 34 and the second roller 36 by using a simple configuration.

Moreover, according to the drive transferring unit 50, since the clutch gear 59 and the main body section 58 have a common central axis denoted by the first virtual line C1 and the clutch gear 67 and the main body section 66 have a common central axis denoted by the second virtual line C2, an installation space of the second transferring path 56 is reduced compared with a configuration in which components from the clutch gear 59 to the main body section 66 are separately arranged, thus making it possible to reduce the size of the drive transferring unit 50.

According to the drive transferring unit 50, it is possible to reduce the number of components required to form the second transferring path 56 compared with a configuration in which a rotating body is used instead of the clutch gear 59 to constitute a portion of the second transferring path 56.

Moreover, according to the drive transferring unit 50, when the control section 26 selects the second control while the first control is performed or selects the first control while the second control is performed, the rotational direction of the first roller 34 and the rotational direction of the second roller 36 are switched, thus making it possible to switch the rotational direction of the first roller 34 and the rotational direction of the second roller 36 by using a simple configuration.

Further, according to the drive transferring unit 50, since the rotational direction of the first roller 34 matches the rotational direction of the second roller 36, the first roller 34 and the second roller 36 are able to be arranged on the inverting path T5, which is an example of the identical transport path. Note that, at this time, the rotational speed of the first roller 34 may be the same as or differ from the rotational speed of the second roller 36. When the rotational speed of the first roller 34 and the rotational speed of the second roller 36 for transporting a single medium M are the same, the single medium M is readily transported without a posture change. Moreover, when the rotational speed of the first roller 34 and the rotational speed of the second roller 36 for transporting a single medium M differ from each other, tension is readily applied to the single medium M, or the single medium M readily warps. When tension is applied to the medium M, the drive transferring unit 50 is usable to correct curling of the medium M. For example, tension may be applied to the medium M by the pairs of transport rollers 29 and 31. When the medium M is caused to warp, the drive transferring unit 50 is usable to correct skewing of the medium M. For example, the medium M may be caused to warp by the pairs of transport rollers 27 and 28.

According to the drive transferring unit 50, the configuration for transferring the driving force is not arranged significantly near to one side with respect to the first roller 34 and the second roller 36 in the Y direction, thus easily securing a space in which the transferring section 72 is arranged.

Moreover, according to the drive transferring unit 50, when the control is switched from one of the first control and the second control to the other, the first clutch 57 and the second clutch 65 interrupt transfer of the driving force F during a time between the first control and the second control, thus making it possible to prevent one of the clutches from transferring the driving force F in a state in which the other incompletely interrupts transfer of the driving force F.

According to the drive transferring unit 50, since the drive gear 54 rotates in only the direction −R, which is an example of the one direction, it is possible to transport the medium M without using the motor 51 capable of rotating in forward and reverse directions.

Moreover, according to the drive transferring unit 50, since the transport direction of the medium M is switched by the first roller 34 and the second roller 36 on the inverting path T5, it is possible to set a dimension of the inverting path T5 to be long compared with a configuration in which only a single roller is used on the inverting path T5.

According to the drive transferring unit 50, it is possible to enable transfer of the driving force F and interrupt transfer of the driving force F on the first shaft section 33, thus making it possible to shorten time required to switch the control from one of the first control and the second control to the other compared with a configuration in which the first clutch 57 is not arranged on the first shaft section 33.

Moreover, according to the drive transferring unit 50, in a state in which no medium M exists, the first roller 34 and the opposed roller 42 form a nip, and the second roller 36 and the opposed roller 44 form a nip. In this manner, since a plurality of nips are formed, it is possible to disperse a nip force acting on the medium M. Accordingly, it is possible to suppress the transfer of the ink K attached to the medium M to a roller due to nipping the medium M.

The printer 1 is able to exhibit an operational effect similar to that of the drive transferring unit 50.

Embodiment 2

Next, configurations of a drive transferring unit 80 and the printer 1 according to Embodiment 2, which are respective examples of the drive transferring device and the liquid ejecting apparatus according to the disclosure, will be specifically described. Note that the same parts as those of Embodiment 1 will be given the same reference numerals, and description thereof will be omitted.

Figure 7:
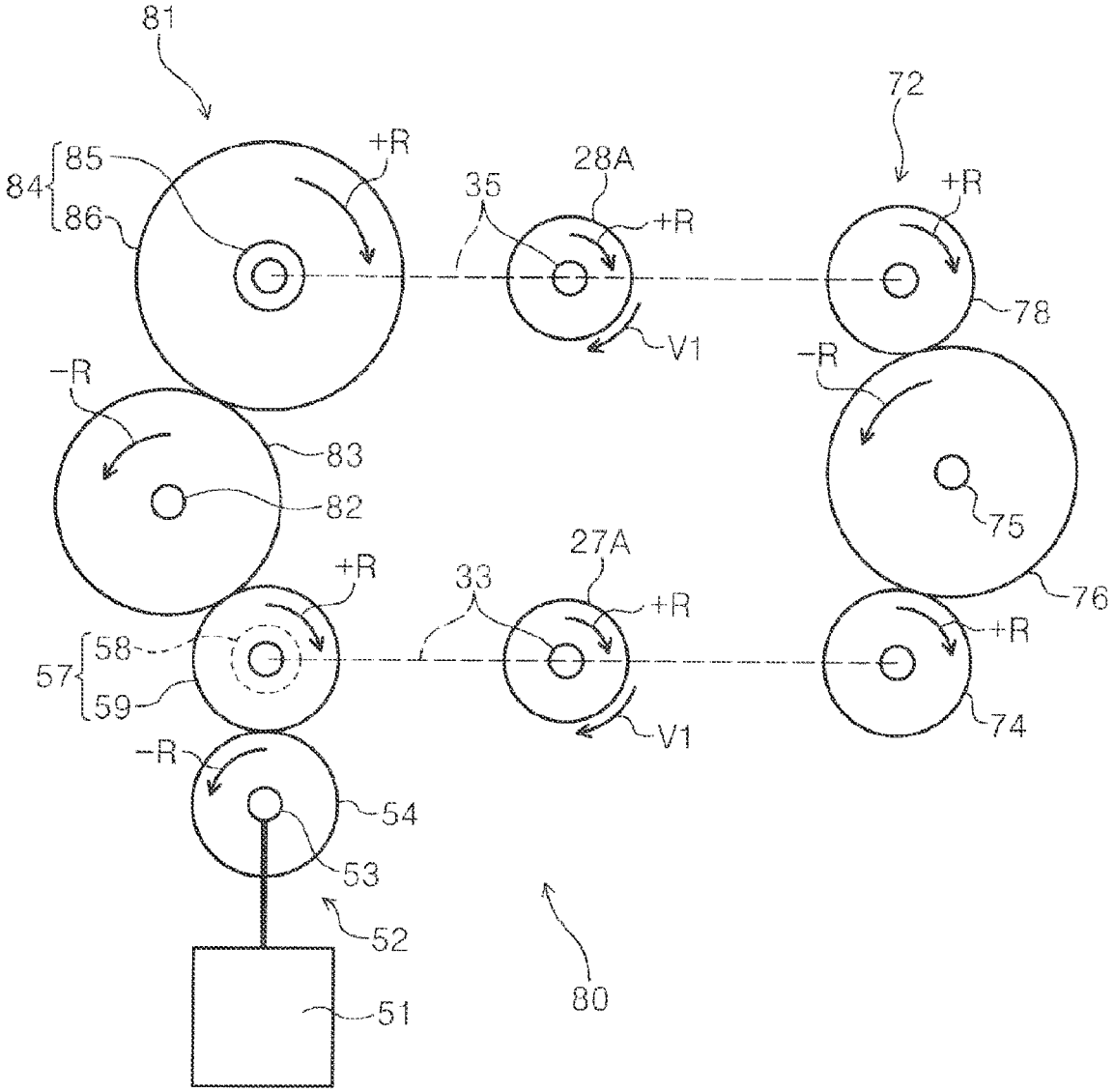
FIG. 7 is a schematic view illustrating rotational directions of gears, clutches, a first roller, and a second roller during control with first speed in a drive transferring unit according to Embodiment 2.

As illustrated in FIG. 7, the drive transferring unit 80 of Embodiment 2 differs from the drive transferring unit 50 (FIG. 2) of Embodiment 1 in that a second transferring path 81 is provided instead of the second transferring path 56. The other configurations are similar to those of the drive transferring unit 50.

The second transferring path 81 is a path for transferring the driving force from the motor 51 to the second shaft section 35. The second transferring path 81 is constituted by, for example, the drive gear 54, the first clutch 57, an idler gear 83, and a second clutch 84. That is, a difference lies in that the idler gear 83 and the second clutch 84 are provided instead of the idler gears 62 and 64 and the second clutch 65 (FIG. 2).

The idler gear 83 is provided to be rotatable about a shaft section 82 extending in the Y direction. A tooth section of the idler gear 83 engages the tooth section of the clutch gear 59 and a tooth section of a clutch gear 86 described later.

The second clutch 84, which is an example of the second switching section, is provided on the second transferring path 81 and is configured to be able to switch between enabling transfer of the driving force F and interrupting transfer of the driving force F. The on state is a state in which the driving force is transferred, and the off state is a state in which transfer of the driving force is interrupted. Specifically, the second clutch 84 is configured as an electromagnetic clutch and includes a main body section 85 and the clutch gear 86.

The main body section 85 is an example of the fourth rotating body. Moreover, the main body section 85 includes therein a coil (not illustrated) and generates a magnetic force when energized by the power supply of the printer 1. Moreover, the main body section 85 is integrated with the second shaft section 35. The end of the second shaft section 35 in the +Y direction is inserted into a through hole of the clutch gear 86.

Of the pairs of transport rollers 27, 28, 29, and 31 of Embodiment 2, the roller 27A is an example of the first roller. The roller 28A is an example of the second roller. The roller 27A and the roller 28A function as drive rollers.

The first clutch 57 and the second clutch 84 are located in the +Y direction with respect to the roller 27A and the roller 28A in the Y direction, respectively.

The clutch gear 86 includes a metal plate (not illustrated). The clutch gear 86 is an example of the third rotating body. A second virtual line C2 (FIG. 2) extending in the Y direction denotes the common central axis of the main body section 85 and the clutch gear 86.

When the second clutch 84 does not enable the main body section 85 to be energized, the clutch gear 86 does not move in conjunction with the main body section 85 and is rotatable alone about the second shaft section 35.

When the second clutch 84 enables the main body section 85 to be energized, the main body section 85 attracts the metal plate of the clutch gear 86 with a magnetic force, and the clutch gear 86 is thereby integrated with the main body section 85 and rotates upon rotation of the second shaft section 35.

In the drive transferring unit 80, the roller 27A and the roller 28A switch the rotational speed between rotational speed V1 and rotational speed V2 when control is switched from one of the first control and the second control to the other. The rotational speed V2 is lower than the rotational speed V1. Switching between the first control and the second control does not change the rotational direction.

Specifically, the number of teeth of the clutch gear 86 is, for example, twice the number of teeth of the clutch gear 59. The outer diameter of the roller 28A is substantially the same as the outer diameter of the roller 27A. The number of teeth of the transferring gear 78 is the same as the number of teeth of the transferring gear 74. Accordingly, when the first clutch 57 enables transfer of the driving force, the rotational speed of each of the roller 27A and the roller 28A is the rotational speed V1. When the second clutch 84 enables transfer of the driving force, the rotational speed of each of the roller 27A and the roller 28A is the rotational speed V2.

Next, operation of the printer 1 and the drive transferring unit 80 according to Embodiment 2 will be described. Note that the same parts as those of Embodiment 1 will be given the same reference numerals, and description thereof will be omitted.

As illustrated in FIG. 7, the first clutch 57 is in the state of enabling transfer of the driving force. The second clutch 84 is in the state of interrupting transfer of the driving force F.

When the drive gear 54 rotates in the direction −R, the clutch gear 59 rotates in the direction +R on the first transferring path 52. Accordingly, the roller 27A and the transferring gear 74 rotate in the direction +R. When the transferring section 72 transfers the driving force, the transferring gear 78 and the roller 28A rotate in the direction +R. At this time, the rotational speed of each of the roller 27A and the roller 28A is the rotational speed V1.

On the other hand, when the clutch gear 59 rotates in the direction +R, the clutch gear 86 rotates in the direction +R on the second transferring path 81. Here, although the main body section 85 rotates in the direction +R upon rotation of the roller 28A in an integral manner, the second clutch 84 is in the state of interrupting transfer of the driving force F, and the main body section 85 and the clutch gear 86 thus rotate in the direction +R without interfering with each other. In this manner, when the first clutch 57 is in the state of enabling transfer of the driving force F and when the second clutch 84 is in the interrupting state, the transferring section 72 transfers the driving force from the roller 27A to the roller 28A. The roller 27A and the roller 28A then rotate in the direction +R at the rotational speed V1.

Figure 8:
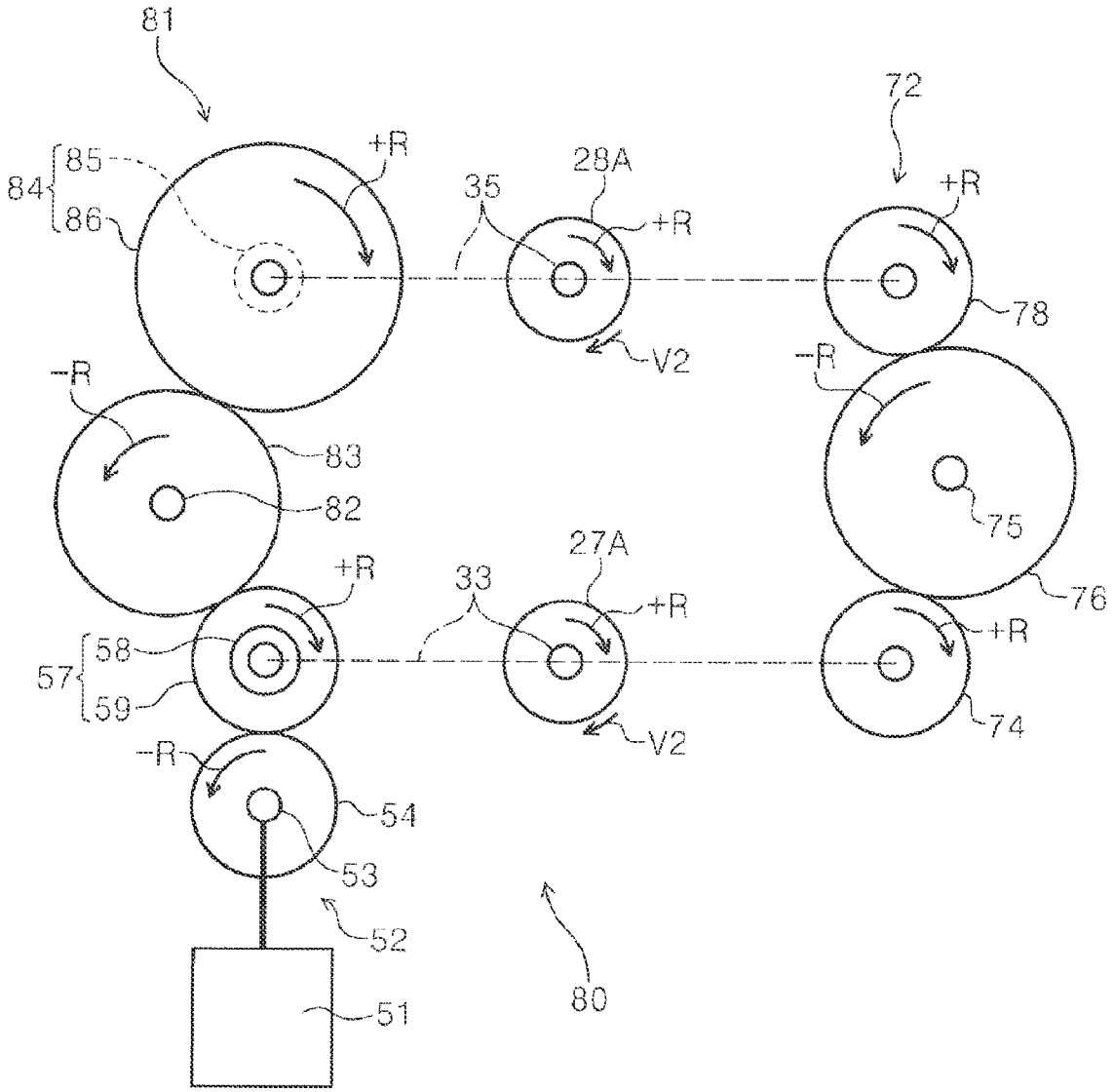
FIG. 8 is a schematic view illustrating rotational directions of the gears, the clutches, the first roller, and the second roller during control with second speed in the drive transferring unit according to Embodiment 2.

As illustrated in FIG. 8, the first clutch 57 is in the state of interrupting transfer of the driving force F. The second clutch 84 is in the state of enabling transfer of the driving force.

When the drive gear 54 rotates in the direction −R, the clutch gear 59 rotates in the direction +R on the first transferring path 52. At this time, the main body section 58 does not rotate.

When the clutch gear 59 rotates in the direction +R, the clutch gear 86 rotates in the direction +R on the second transferring path 81. Here, since the second clutch 84 is in the state of enabling transfer of the driving force, the main body section 85 rotates in the direction +R, and the roller 28A and the transferring gear 78 rotate in the direction +R. When the transferring section 72 transfers the driving force, the transferring gear 74 and the roller 27A rotate in the direction +R.

Although the main body section 58 rotates in the direction +R upon rotation of the roller 27A in an integral manner, the first clutch 57 is in the interrupting state, and the main body section 58 and the clutch gear 59 thus rotate in the same direction without interfering with each other.

In this manner, when the first clutch 57 is in the interrupting state and when the second clutch 84 is in the state of enabling transfer of the driving force, the transferring section 72 transfers the driving force from the roller 28A to the roller 27A. The roller 27A and the roller 28A thus rotate in the direction +R at the rotational speed V2.

According to the drive transferring unit 80, when the control section 26 selects the second control while the first control is performed or selects the first control while the second control is performed, the rotational speed of each of the roller 27A and the roller 28A is switched to the rotational speed V1 or the rotational speed V2, thus making it possible to switch the rotational speed of each of the roller 27A and the roller 28A by using a simple configuration.

Here, in an instance in which the roller 27A and the roller 28A respectively constitute the pair of transport rollers 27 and the pair of transport rollers 28 while the transport speed of the transport unit 10 is able to be switched, when the printing speed of the line head 30 is set to be lower than reference speed, it is possible to enhance printing resolution of the medium M in the transport direction. When the printing speed of the line head 30 is set to be higher than the reference speed, it is possible to improve throughput.

On the other hand, when the roller 27A and the roller 28A respectively constitute the pair of transport rollers 29 and the pair of transport rollers 31, by setting the transport speed of the medium M immediately before being discharged to be lower than the reference speed and setting drying time of the ink K on the medium on the transport path T3 to be longer than a reference time, it is possible to suppress curling of the medium M.

Note that the configuration of the drive transferring unit 80 may be applied to the first roller 34 and the second roller 36 instead of the roller 27A and the roller 28A.

Embodiment 3

Next, configurations of a drive transferring unit 90 and the printer 1 according to Embodiment 3, which are respective examples of the drive transferring device and the liquid ejecting apparatus according to the disclosure, will be specifically described. Note that the same parts as those of Embodiments 1 and 2 will be given the same reference numerals, and description thereof will be omitted.

Figure 9:
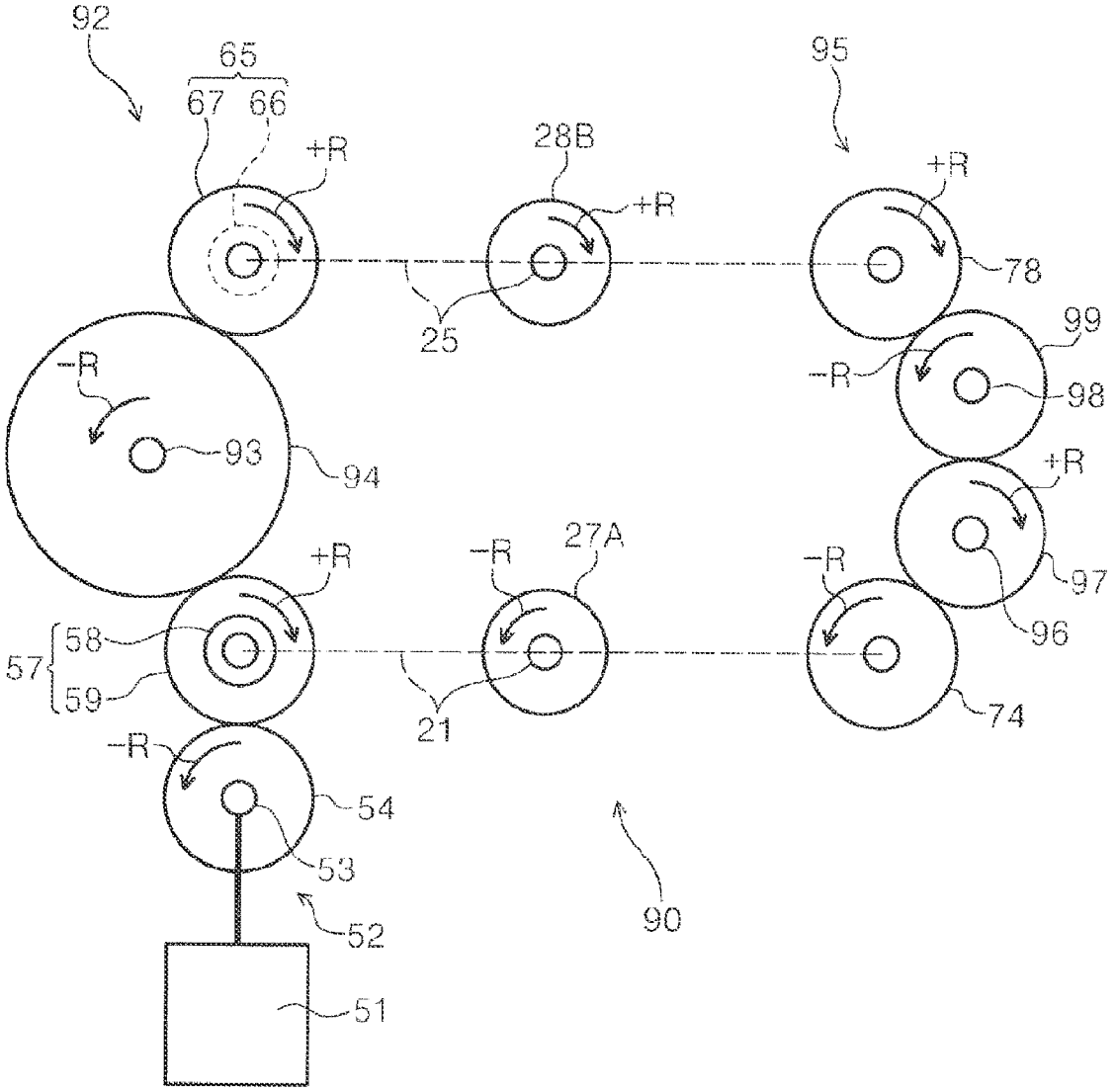
FIG. 9 is a schematic view illustrating a state in which a drive transferring unit according to Embodiment 3 enables a first roller and a second roller to rotate in different directions.

As illustrated in FIG. 9, the drive transferring unit 90 includes the roller 27A and the roller 28B of the pairs of transport rollers 29 and 31 (FIG. 1), the first clutch 57, the second clutch 65, a transferring section 95, and the control section 26 (FIG. 2). The drive transferring unit 90 transfers the driving force F to the roller 27A and the roller 28B.

The roller 27A, which is an example of the first roller, includes a first shaft section 21 extending in the Y direction and transports the medium M. The roller 27A comes into contact with the surface of the medium M, which is not subjected to recording during single-side printing. The first shaft section 21 has a column shape whose central axis extends in the Y direction. Each end of the first shaft section 21 in the Y direction is rotatably supported by the aforementioned main body frame via a bearing. The end of the first shaft section 21 in the −Y direction is inserted into a through hole of the transferring gear 74.

The roller 28B, which is an example of the second roller, includes a second shaft section 25 extending in the Y direction and transports the medium M. The roller 28B comes into contact with the surface of the medium M, which is subjected to recording during single-side printing. The second shaft section 25 has a column shape whose central axis extends in the Y direction. Each end of the second shaft section 25 in the Y direction is rotatably supported by the aforementioned main body frame via a bearing. The end of the second shaft section 25 in the −Y direction is inserted into a through hole of the transferring gear 78.

In Embodiment 3, the roller 27A and the roller 28B function as drive rollers.

The transferring section 95 is located in the −Y direction, that is, on the other side with respect to the roller 27A and the roller 28B in the Y direction. The transferring section 95 transfers the driving force F from one of the roller 27A and the roller 28B to the other. The transferring section 95 includes, for example, the transferring gear 74, an idler gear 97, an idler gear 99, and the transferring gear 78.

The idler gear 97 is provided to be rotatable about a shaft section 96 extending in the Y direction. A tooth section of the idler gear 97 engages the tooth section of the transferring gear 74 and a tooth section of the idler gear 99.

The idler gear 99 is provided to be rotatable about a shaft section 98 extending in the Y direction. The tooth section of the idler gear 99 engages the tooth section of the idler gear 97 and the tooth section of the transferring gear 78.

The transferring section 95 enables the roller 27A and the roller 28B to rotate in different directions that are opposite to each other. The outer diameters of the respective gears of the drive transferring unit 90 are set such that the roller 27A and the roller 28B rotate in different rotational directions at substantially the same rotational speed.

A second transferring path 92 is a path for transferring the driving force from the motor 51 to the second shaft section 25. The second transferring path 92 is constituted by, for example, the drive gear 54, the first clutch 57, an idler gear 94, and the second clutch 65.

The idler gear 94 is provided to be rotatable about a shaft section 93 extending in the Y direction. A tooth section of the idler gear 94 engages the tooth section of the clutch gear 59 and the tooth section of the clutch gear 67.

Next, operation of the printer 1 and the drive transferring unit 90 according to Embodiment 3 will be described. Note that the same parts as those of Embodiments 1 and 2 will be given the same reference numerals, and description thereof will be omitted.

As illustrated in FIG. 9, the first clutch 57 is in the state of interrupting transfer of the driving force F. The second clutch 65 is in the state of enabling transfer of the driving force.

When the drive gear 54 rotates in the direction −R, the clutch gear 59 rotates in the direction +R on the first transferring path 52. At this time, the main body section 58 does not rotate.

When the clutch gear 59 rotates in the direction +R, the clutch gear 67 rotates in the direction +R on the second transferring path 92. Here, since the second clutch 65 is in the state of enabling transfer of the driving force, the main body section 66 rotates in the direction +R, and the roller 28B and the transferring gear 78 rotate in the direction +R. When the transferring section 95 transfers the driving force, the transferring gear 74 and the roller 27A rotate in the direction −R.

Although the main body section 58 rotates in the direction −R upon rotation of the roller 27A in an integral manner, the first clutch 57 is in the interrupting state, and the main body section 58 and the clutch gear 59 thus rotate in opposite directions without interfering with each other.

In this manner, when the first clutch 57 is in the interrupting state and when the second clutch 65 is in the state of enabling transfer of the driving force, the transferring section 95 transfers the driving force from the roller 28B to the roller 27A. The roller 27A and the roller 28B then rotate in different directions.

Figure 10:
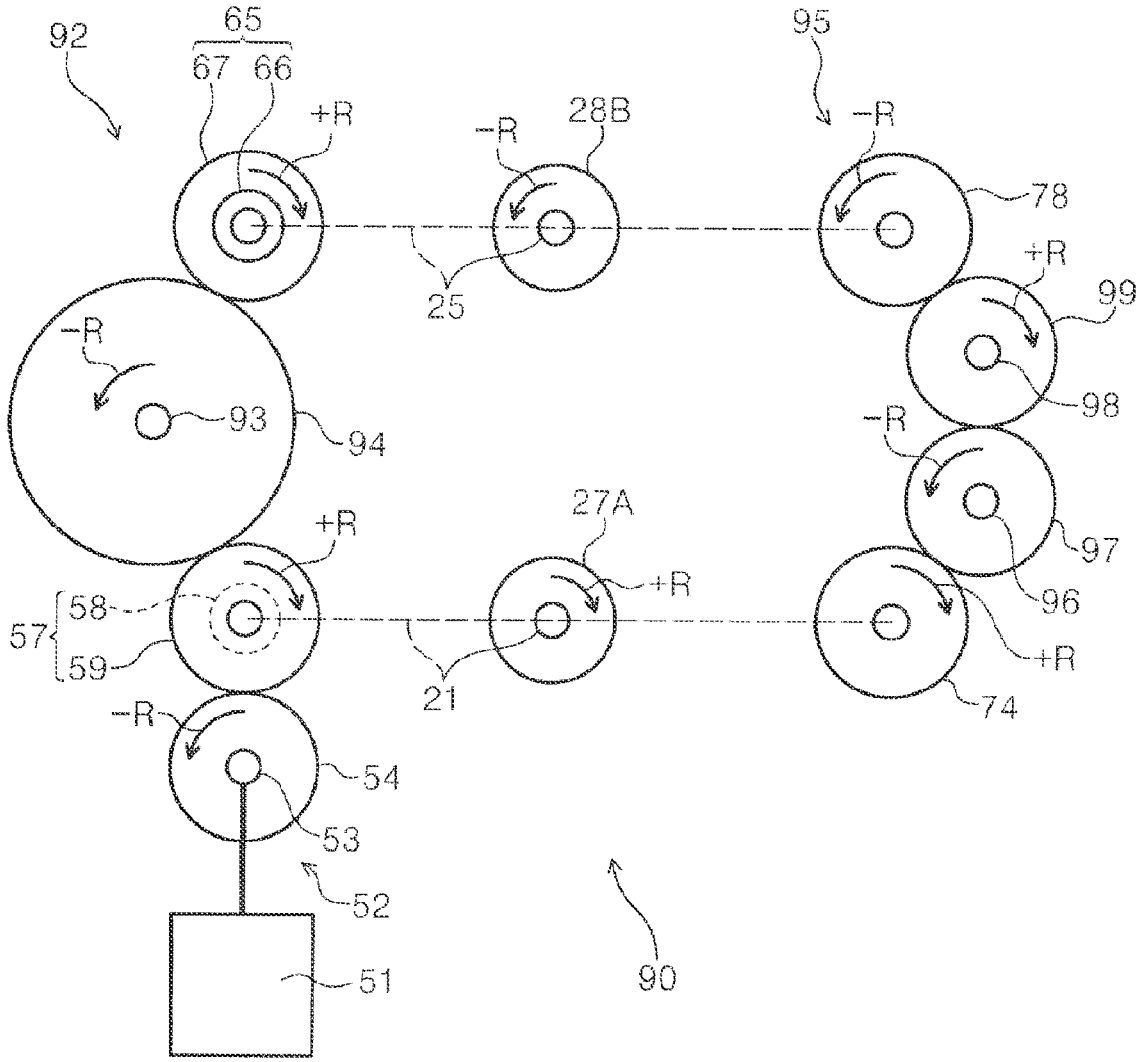
FIG. 10 is a schematic view illustrating a state in which the drive transferring unit according to Embodiment 3 enables the first roller and the second roller to rotate in directions which differ from each other and which are opposite to those in FIG. 9.

As illustrated in FIG. 10, the first clutch 57 is in the state of enabling transfer of the driving force. The second clutch 65 is in the state of interrupting transfer of the driving force F.

When the drive gear 54 rotates in the direction −R, the clutch gear 59 rotates in the direction +R on the first transferring path 52. The roller 27A and the transferring gear 74 thus rotate in the direction +R. When the transferring section 95 transfers the driving force, the transferring gear 78 and the roller 28B rotate in the direction −R.

On the other hand, when the clutch gear 59 rotates in the direction +R, the clutch gear 67 rotates in the direction +R on the second transferring path 92. Here, although the main body section 66 rotates in the direction −R upon rotation of the roller 28B in an integral manner, the second clutch 65 is in the state of interrupting transfer of the driving force F, and the main body section 66 and the clutch gear 67 thus rotate in different directions without interfering with each other. In this manner, when the first clutch 57 is in the state of enabling transfer of the driving force F and when the second clutch 65 is in the interrupting state, the transferring section 95 transfers the driving force from the roller 27A to the roller 28B. The roller 27A and the roller 28B rotate in different directions.

According to the drive transferring unit 90, since the rotational direction of the roller 27A differs from the rotational direction of the roller 28B, the roller 27A and the roller 28B are usable for different purposes.

For example, the roller 27A and the roller 28B may transport the medium M while holding the medium M therebetween, or another roller may be used to perform a process of folding the medium M. Moreover, for example, the roller 27A and the roller 28B may be arranged with the transport path T interposed therebetween such that the rollers may act on the medium M in different directions. Note that, at this time, the rotational speed of the roller 27A may be the same as or differ from the rotational speed of the roller 28B. When the rotational speed of the roller 27A and the rotational speed of the roller 28B for transporting the medium M are the same, the medium M is readily transported without a posture change. Moreover, when the rotational speed of the roller 27A and the rotational speed of the roller 28B for transporting the medium M differ from each other, multi-feeding of media M is easily prevented. The pair of transport rollers 7 may be constituted by the roller 27A and the roller 28B to prevent multi-feeding of media M.

Note that the configuration of the drive transferring unit 90 may be applied to the roller 27A and the roller 28B of the pairs of transport rollers 27 and 28 instead of the pairs of transport rollers 29 and 31.

Embodiment 4

Next, configurations of a drive transferring unit 100 and the printer 1 according to Embodiment 4, which are respective examples of the drive transferring device and the liquid ejecting apparatus according to the disclosure, will be specifically described. Note that the same parts as those of Embodiments 1 to 3 will be given the same reference numerals, and description thereof will be omitted.

Figure 11:
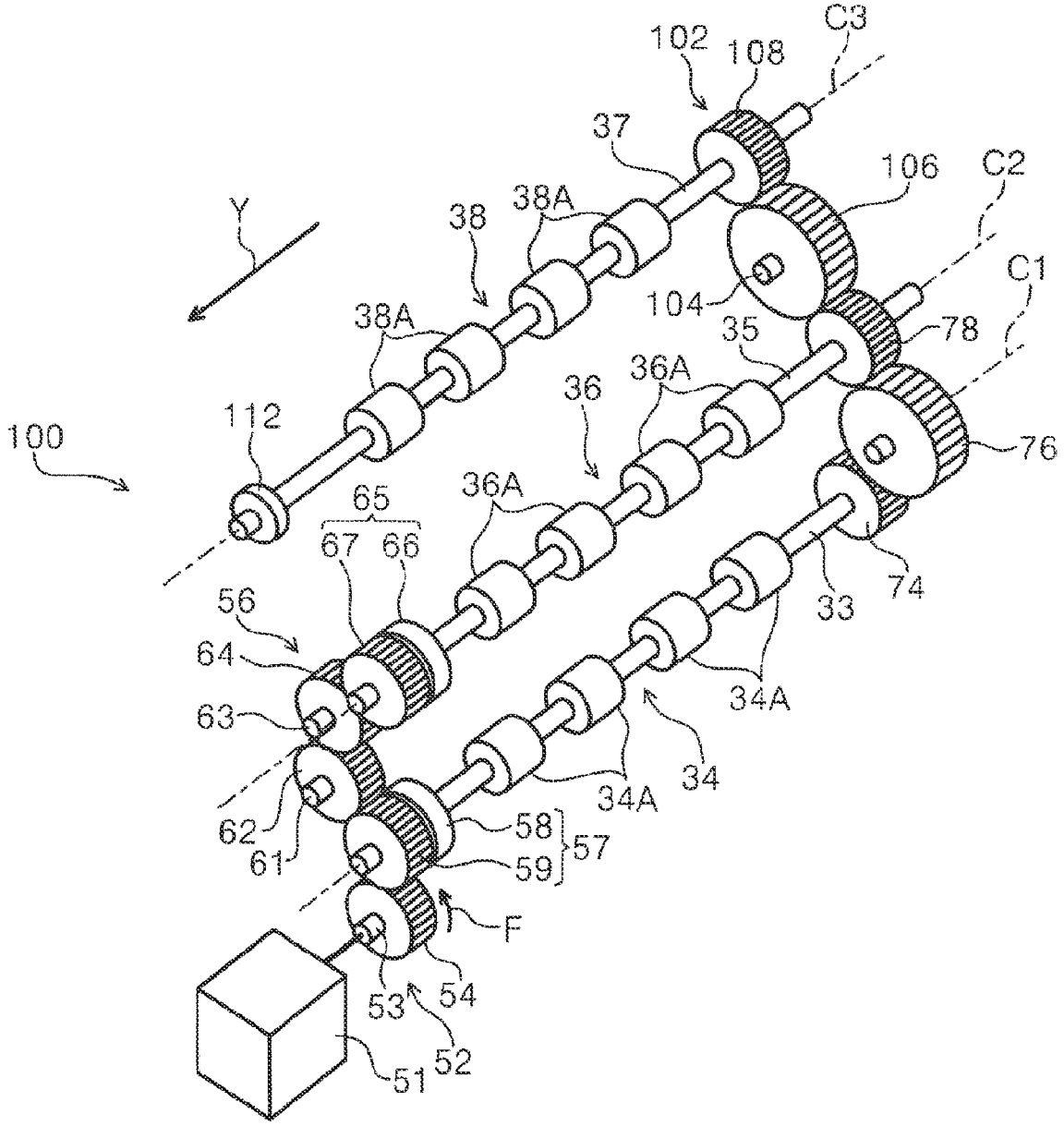
FIG. 11 is a perspective view illustrating a drive transferring unit, a first roller, a second roller, and a third roller according to Embodiment 4.

As illustrated in FIG. 11, the drive transferring unit 100 differs from the drive transferring unit 50 (FIG. 2) in that a transferring section 102 is provided instead of the transferring section 72 (FIG. 2) and that the third roller 38 is further provided. The other configurations are similar to those of the drive transferring unit 50.

The third roller 38 is arranged, for example, in the +Z direction (FIG. 1) with respect to the second roller 36. The third roller 38 includes, for example, a third shaft section 37 extending in the Y direction and four rubber sections 38A and transports the medium M. The third shaft section 37 has a column shape whose central axis extends in the Y direction. The end of the third shaft section 37 in the +Y direction is rotatably supported by the aforementioned main body frame via a bearing 112. The four rubber sections 38A each have a cylindrical shape and are attached to the third shaft section 37.

In this manner, the drive transferring unit 100 includes the third roller 38 for transporting the medium M by receiving the driving force from the transferring section 102.

The transferring section 102 is located in the −Y direction, that is, on the other side with respect to the first roller 34, the second roller 36, and the third roller 38 in the Y direction. Moreover, the transferring section 102 transfers the driving force F from any one of the first roller 34, the second roller 36, and the third roller 38 to the other two rollers. The transferring section 102 includes, for example, the transferring gear 74, the idler gear 76, the transferring gear 78, an idler gear 106, and a transferring gear 108.

The end of the third shaft section 37 in the −Y direction is inserted into a through hole of the transferring gear 108.

The idler gear 106 is provided to be rotatable about a shaft section 104 extending in the Y direction. A tooth section of the idler gear 106 engages the tooth section of the transferring gear 78 and a tooth section of the transferring gear 108.

The outer diameters of the respective gears of the drive transferring unit 100 are set such that the first roller 34, the second roller 36, and the third roller 38 rotate in the same rotational direction at substantially the same rotational speed.

Next, operation of the printer 1 and the drive transferring unit 100 according to Embodiment 4 will be described. Note that the same parts as those of Embodiments 1 to 3 will be given the same reference numerals, and description thereof will be omitted.

Figure 12:
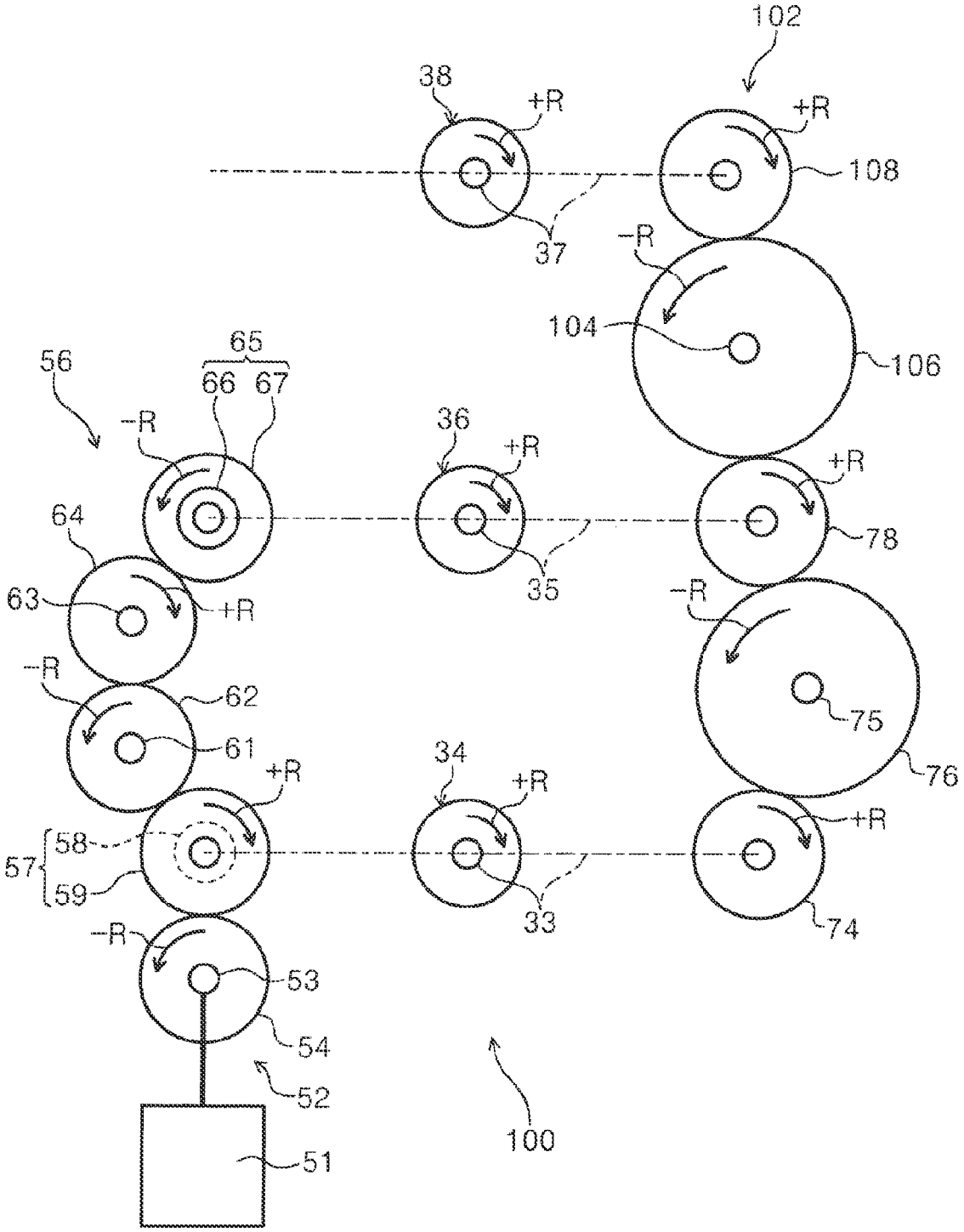
FIG. 12 is a schematic view illustrating rotational directions of gears, clutches, the first roller, the second roller, and the third roller during control in the drive transferring unit according to Embodiment 4.

As illustrated in FIG. 12, the first clutch 57 is in the state of enabling transfer of the driving force. The second clutch 65 is in the state of interrupting transfer of the driving force F.

When the drive gear 54 rotates in the direction −R, the clutch gear 59 rotates in the direction +R on the first transferring path 52. The first roller 34 and the transferring gear 74 thus rotate in the direction +R. When the transferring section 102 transfers the driving force, the transferring gear 78, the second roller 36, the transferring gear 108, and the third roller 38 rotate in the direction +R.

On the other hand, when the clutch gear 59 rotates in the direction +R, the clutch gear 67 rotates in the direction −R on the second transferring path 56. Here, although the main body section 66 rotates in the direction +R upon rotation of the second roller 36 in an integral manner, the second clutch 65 is in the state of interrupting transfer of the driving force F, and the main body section 66 and the clutch gear 67 thus rotate in different directions without interfering with each other. In this manner, when the first clutch 57 is in the state of enabling transfer of the driving force and when the second clutch 65 is in the interrupting state, the transferring section 102 transfers the driving force from the first roller 34 to the second roller 36 and the third roller 38. The first roller 34, the second roller 36, and the third roller 38 then rotate in the direction +R. Accordingly, the medium M is transported in the +Z direction on the inverting path T5 (FIG. 1).

Figure 13:
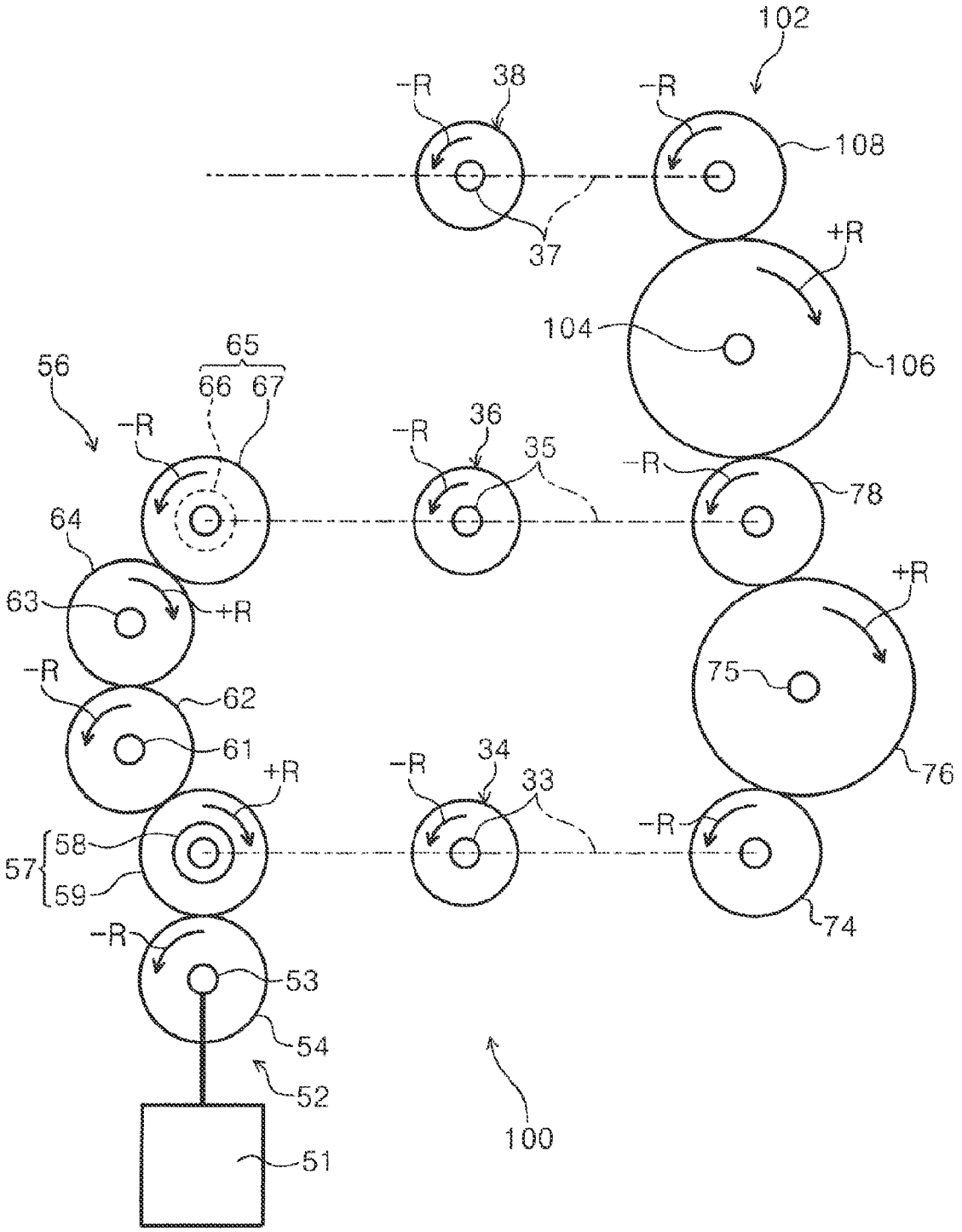
FIG. 13 is a schematic view illustrating rotational directions of the gears, the clutches, the first roller, the second roller, and the third roller during control in the drive transferring unit according to Embodiment 4.

As illustrated in FIG. 13, the first clutch 57 is in the state of interrupting transfer of the driving force F. The second clutch 65 is in the state of enabling transfer of the driving force.

When the drive gear 54 rotates in the direction −R, the clutch gear 59 rotates in the direction +R on the first transferring path 52. At this time, the main body section 58 does not rotate.

When the clutch gear 59 rotates in the direction +R, the clutch gear 67 rotates in the direction −R on the second transferring path 56. Here, since the second clutch 65 is in the state of enabling transfer of the driving force, the main body section 66 rotates in the direction +R, and the second roller 36 and the transferring gear 78 thus rotate in the direction −R. When the transferring section 102 transfers the driving force, the transferring gear 74, the first roller 34, the transferring gear 108, and the third roller 38 rotate in the direction −R.

Although the main body section 58 rotates in the direction −R upon rotation of the first roller 34 in an integral manner, the first clutch 57 is in the interrupting state, and the main body section 58 and the clutch gear 59 thus rotate in opposite directions without interfering with each other. In this manner, when the first clutch 57 is in the interrupting state and when the second clutch 65 is in the state of enabling transfer of the driving force, the transferring section 102 transfers the driving force from the second roller 36 to the first roller 34 and the third roller 38. The transferring gear 74, the first roller 34, the transferring gear 108, and the third roller 38 then rotate in the direction −R. Accordingly, the medium M is transported in the −Z direction on the inverting path T5 (FIG. 1).

According to the drive transferring unit 100, it is possible to provide the third roller 38 and control rotation of the third roller 38 without affecting the configurations of the first transferring path 52 and the second transferring path 56.

Embodiment 5

Next, configurations of a drive transferring unit 120 and the printer 1 according to Embodiment 5, which are respective examples of the drive transferring device and the liquid ejecting apparatus according to the disclosure, will be specifically described. Note that the same parts as those of Embodiments 1 to 4 will be given the same reference numerals, and description thereof will be omitted.

Figure 14:
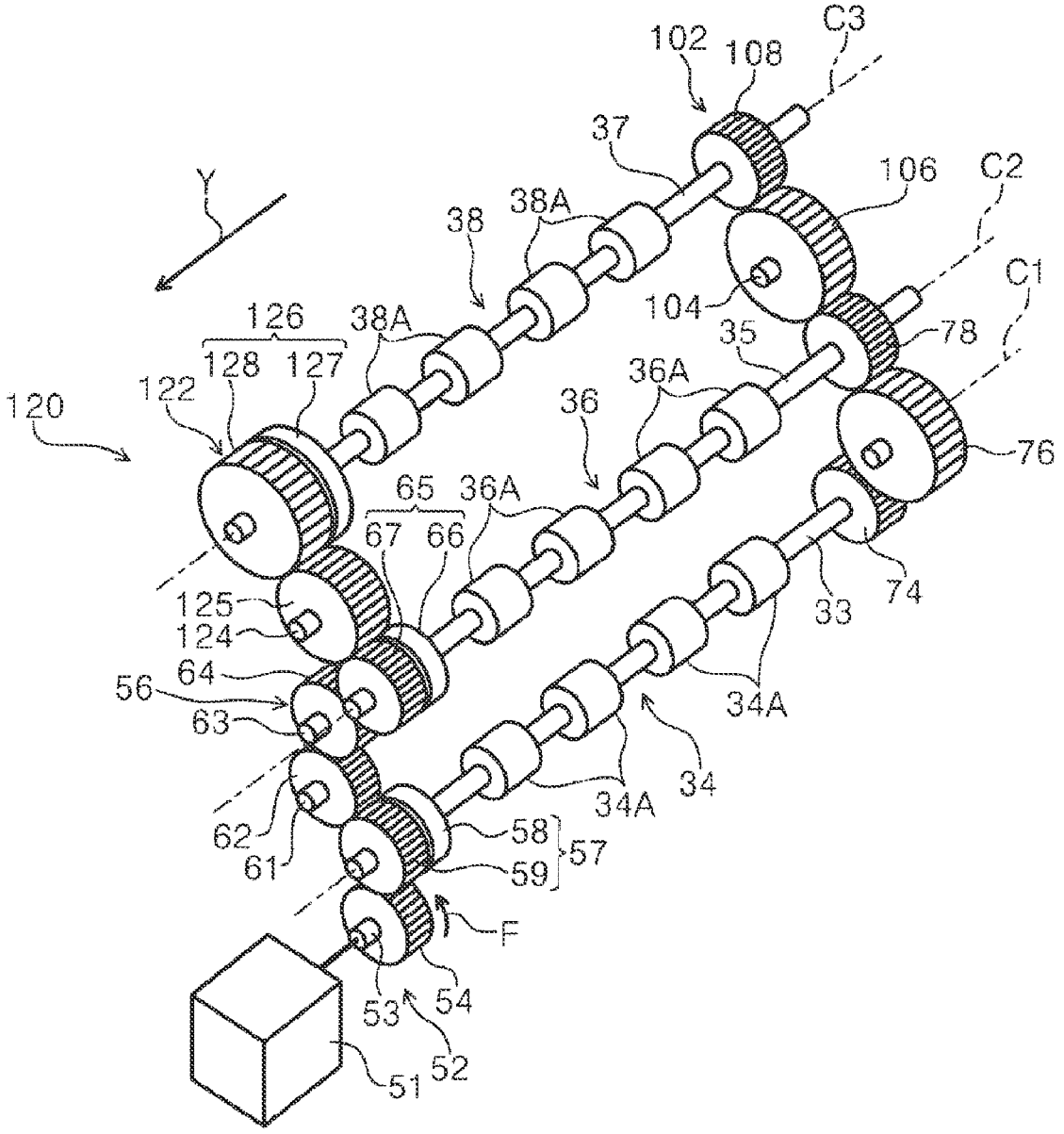
FIG. 14 is a perspective view illustrating a drive transferring unit, a first roller, a second roller, and a third roller according to Embodiment 5.

As illustrated in FIG. 14, the drive transferring unit 120 differs from the drive transferring unit 100 (FIG. 11) in that a third transferring path 122 is added. The other configurations are similar to those of the drive transferring unit 100. Description of the second transferring path 56 will be omitted.

The third transferring path 122 is a path for transferring the driving force F from the motor 51 to the third shaft section 37. Moreover, the third transferring path 122 is constituted by, for example, the drive gear 54, the first clutch 57, the idler gear 62, the idler gear 64, the clutch gear 67, an idler gear 125, and the third clutch 126.

The idler gear 125 is provided to be rotatable about a shaft section 124 extending in the Y direction. A tooth section of the idler gear 125 engages the tooth section of the clutch gear 67 and a tooth section of a clutch gear 128 described later.

The third clutch 126, which is an example of the third switching section, is provided on the third transferring path 122 and is configured to be able to switch between enabling transfer of the driving force F and interrupting transfer of the driving force F. The on state is a state in which the driving force F is transferred, and the off state is a state in which transfer of the driving force F is interrupted. Specifically, the third clutch 126 is configured as an electromagnetic clutch and includes a main body section 127 and the clutch gear 128.

The main body section 127 includes therein a coil (not illustrated) and generates a magnetic force when energized by the power supply of the printer 1 (FIG. 1). Moreover, the main body section 127 is integrated with the third shaft section 37. The end of the third shaft section 37 in the +Y direction is inserted into a through hole of the clutch gear 128.

The first clutch 57, the second clutch 65, and the third clutch 126 are located in the +Y direction with respect to the first roller 34, the second roller 36, and the third roller 38 in the Y direction.

The clutch gear 128 includes a metal plate (not illustrated). A third virtual line C3 extending in the Y direction denotes the common central axis of the main body section 127 and the clutch gear 128.

When the third clutch 126 does not enable the main body section 127 to be energized, the clutch gear 128 does not move in conjunction with the main body section 127 and is rotatable alone about the third shaft section 37.

When the third clutch 126 enables the main body section 127 to be energized, the main body section 127 attracts the metal plate of the clutch gear 128 with a magnetic force, and the clutch gear 128 is thereby integrated with the main body section 127 and rotates upon rotation of the third shaft section 37.

Moreover, the number of teeth of the clutch gear 128 is, for example, twice the number of teeth of the clutch gear 59 and twice the number of teeth of the clutch gear 86.

According to the printer 1 of Embodiment 5, the control section 26 (FIG. 1) causes any one of the first clutch 57, the second clutch 65, and the third clutch 126 to enable transfer of the driving force F and causes the other two clutches to interrupt transfer of the driving force F.

Next, operation of the printer 1 and the drive transferring unit 120 according to Embodiment 5 will be described. Note that the same parts as those of Embodiments 1 to 4 will be given the same reference numerals, and description thereof will be omitted.

Figure 15:
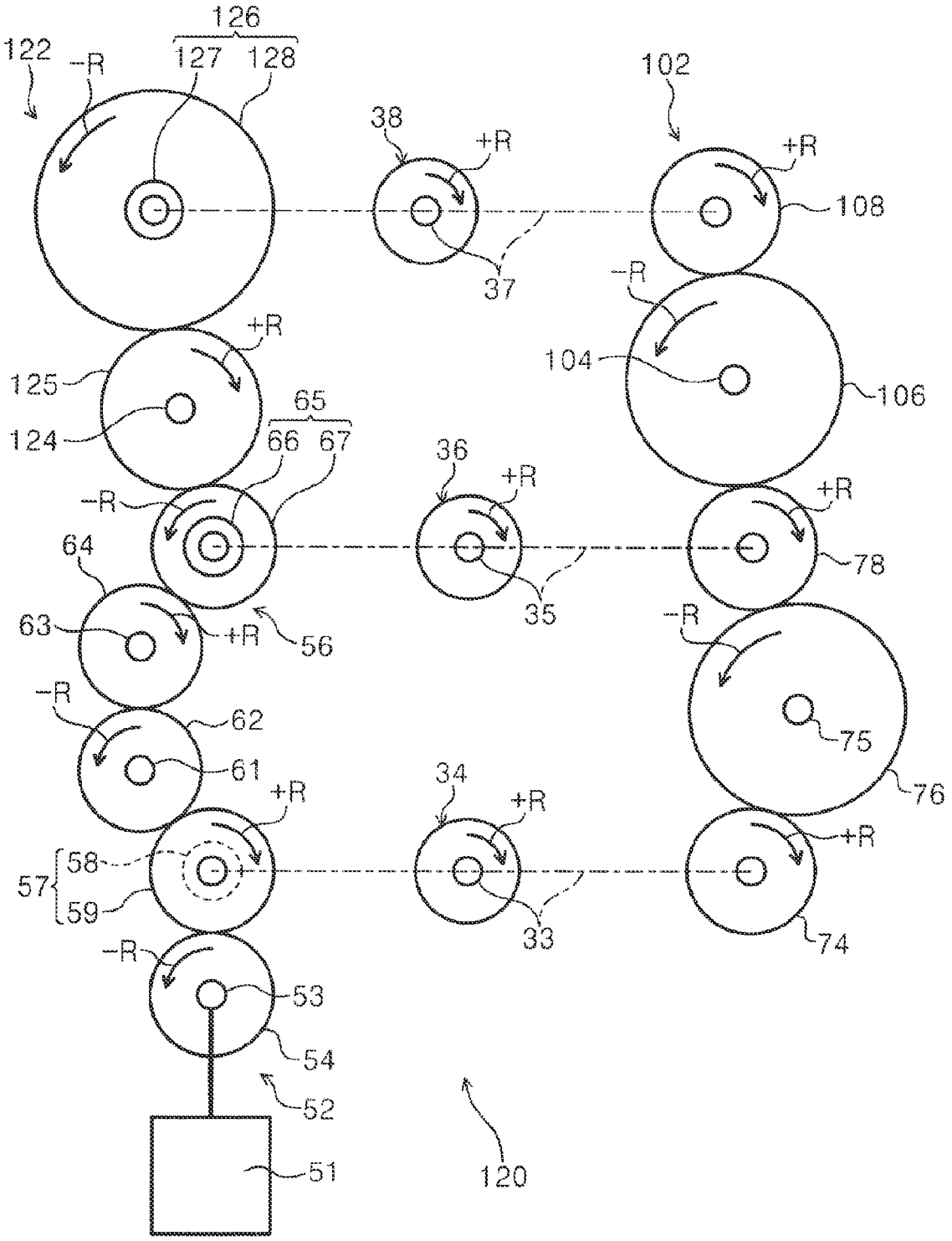
FIG. 15 is a schematic view illustrating rotational directions of gears, clutches, the first roller, the second roller, and the third roller during control in the drive transferring unit according to Embodiment 5.

As illustrated in FIG. 15, the first clutch 57 is in the state of enabling transfer of the driving force. The second clutch 65 is in the state of interrupting transfer of the driving force F. The third clutch 126 is in the state of interrupting transfer of the driving force F.

When the drive gear 54 rotates in the direction −R, the clutch gear 59 rotates in the direction +R on the first transferring path 52. The first roller 34 and the transferring gear 74 thus rotate in the direction +R. When the transferring section 102 transfers the driving force, the transferring gear 78, the second roller 36, the transferring gear 108, and the third roller 38 rotate in the direction +R.

On the other hand, when the clutch gear 59 rotates in the direction +R, the clutch gear 67 rotates in the direction −R on the third transferring path 122. Since the second clutch 65 is in the state of interrupting transfer of the driving force F, the main body section 66 and the clutch gear 67 thus rotate in different directions without interfering with each other.

When the clutch gear 67 rotates in the direction −R, the clutch gear 128 rotates in the direction −R. Since the third clutch 126 is in the state of interrupting transfer of the driving force F, the main body section 127 and the clutch gear 128 thus rotate in different directions without interfering with each other.

In this manner, the first roller 34, the second roller 36, and the third roller 38 rotate in the direction +R. Accordingly, the medium M is transported in the +Z direction on the inverting path T5 (FIG. 1).

Figure 16:
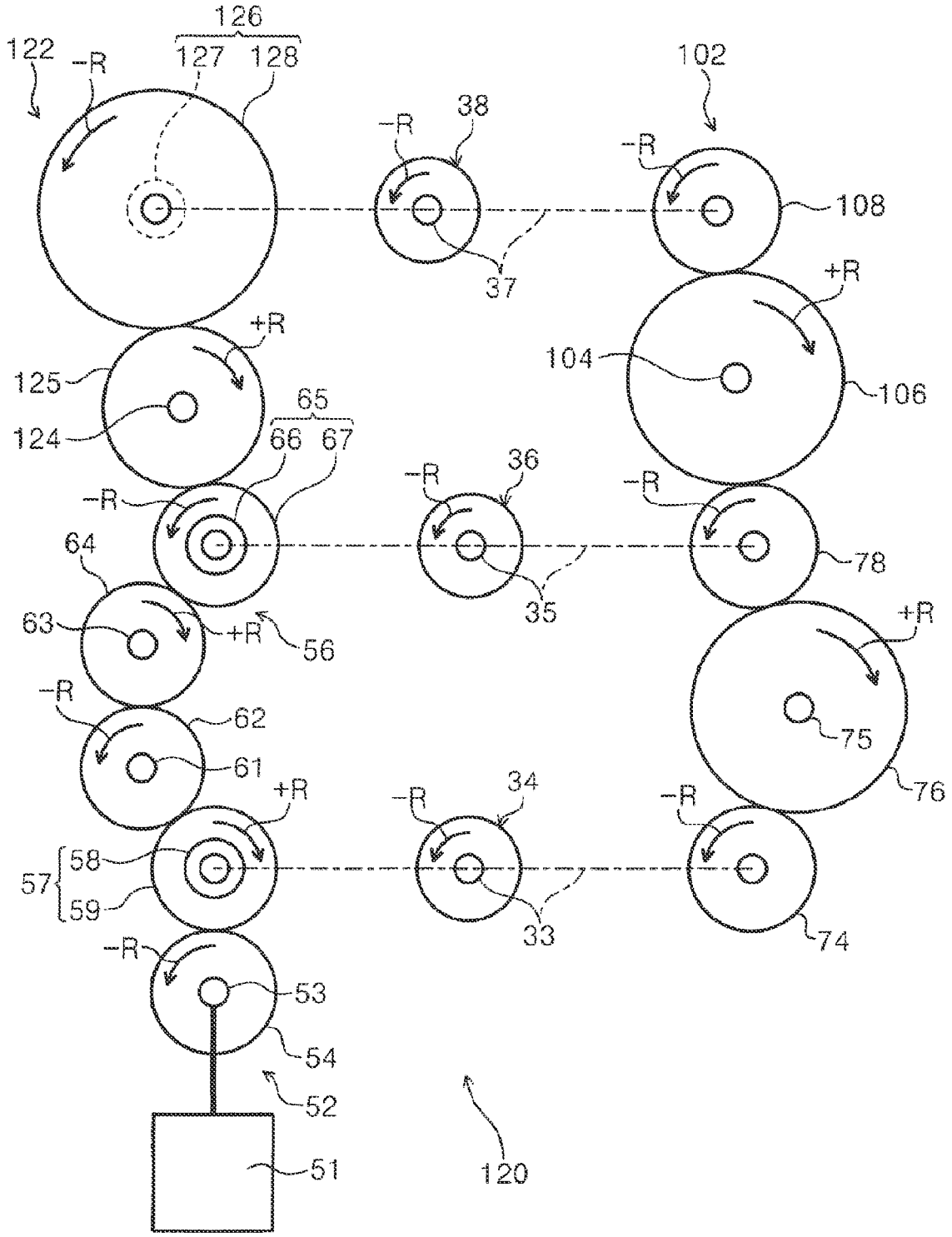
FIG. 16 is a schematic view illustrating rotational directions of the gears, the clutches, the first roller, the second roller, and the third roller during control in the drive transferring unit according to Embodiment 5.

As illustrated in FIG. 16, the first clutch 57 and the second clutch 65 are in the state of interrupting transfer of the driving force F. The third clutch 126 is in the state of enabling transfer of the driving force.

When the drive gear 54 rotates in the direction −R, the clutch gear 59 rotates in the direction +R on the first transferring path 52. At this time, the main body section 58 does not rotate.

The clutch gear 67 and the clutch gear 128 rotate in the direction −R on the third transferring path 122. Here, since the third clutch 126 is in the state of enabling transfer of the driving force, the main body section 127 rotates in the direction −R, and the third roller 38 and the transferring gear 108 thus rotate in the direction −R. When the transferring section 102 transfers the driving force, the transferring gear 74, the first roller 34, the transferring gear 78, and the second roller 36 rotate in the direction −R.

Although the main body section 58 rotates in the direction −R upon rotation of the first roller 34 in an integral manner, the first clutch 57 is in the interrupting state, and the main body section 58 and the clutch gear 59 thus rotate in opposite directions without interfering with each other. In this manner, when the first clutch 57 and the second clutch 65 are in the interrupting state and when the third clutch 126 is in the state of enabling transfer of the driving force F, the transferring section 102 transfers the driving force F from the third roller 38 to the first roller 34 and the second roller 36. The transferring gear 74, the first roller 34, the transferring gear 78, and the second roller 36 then rotate in the direction −R. Accordingly, the medium M is transported in the −Z direction on the inverting path T5 (FIG. 1).

Note that, since the rotational directions of the main body section 66 and the clutch gear 67 of the second clutch 65 are the same, the second clutch 65 may be in the state of enabling transfer of the driving force F.

Since the number of teeth of the clutch gear 128 is larger than, for example, the number of teeth of the clutch gear 59 and the number of teeth of the clutch gear 86, it is possible to set the transport speed when the third clutch 126 is in the state of enabling transfer of the driving force F to be lower than the transport speed when the second clutch 65 is in the state of enabling transfer of the driving force F and the transport speed when the first clutch 57 is in the state of enabling transfer of the driving force F.

According to the drive transferring unit 120, since any one of the first clutch 57, the second clutch 65, and the third clutch 126 is in the state of enabling transfer of the driving force F, it is possible to switch the rotational states of the first roller 34, the second roller 36, and the third roller 38.

Embodiment 6

Next, configurations of a drive transferring unit 130 and the printer 1 according to Embodiment 6, which are respective examples of the drive transferring device and the liquid ejecting apparatus according to the disclosure, will be specifically described. Note that the same parts as those of Embodiments 1 to 5 will be given the same reference numerals, and description thereof will be omitted.

Figure 17:
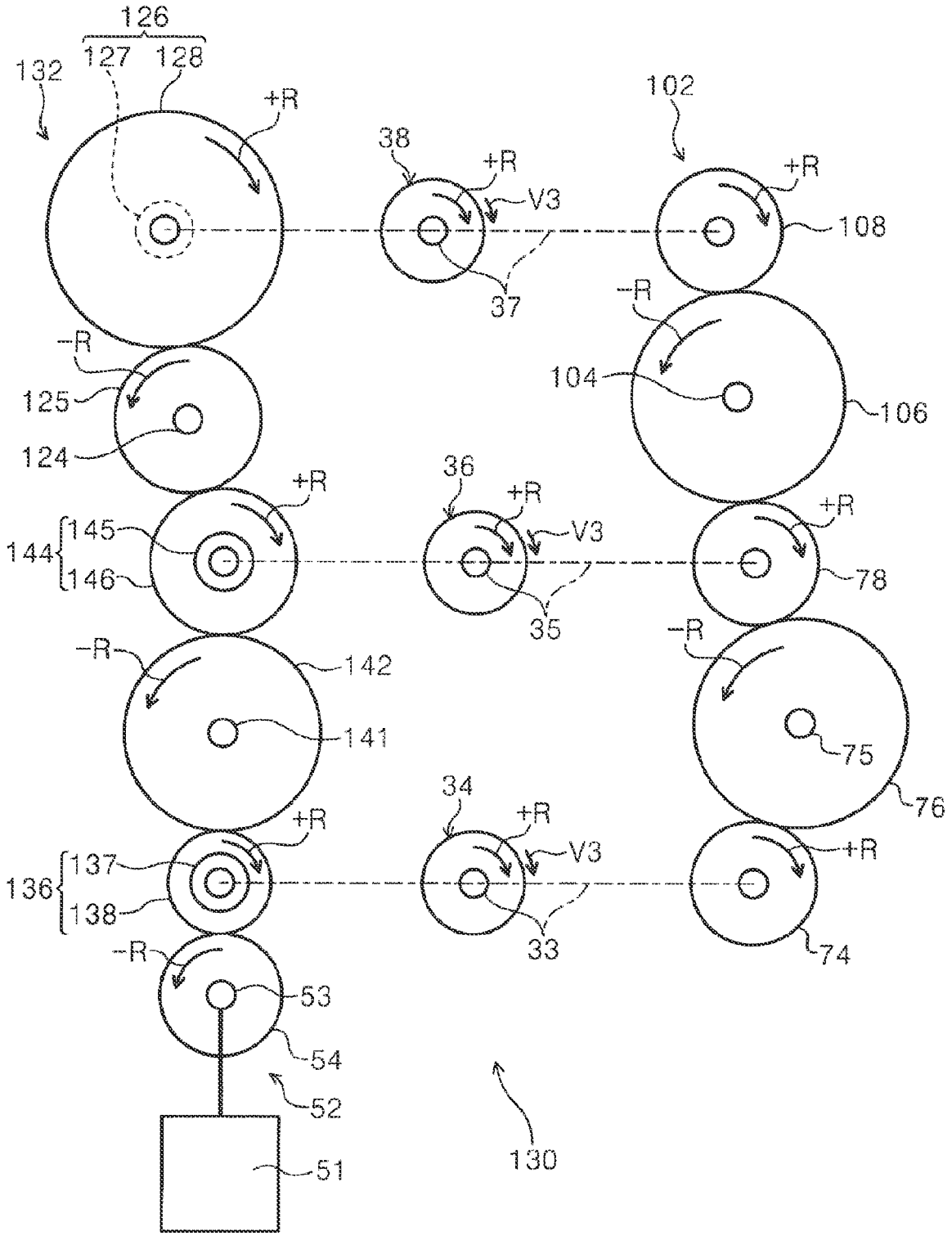
FIG. 17 is a schematic view illustrating rotational directions of gears, clutches, a first roller, a second roller, and a third roller during control in a drive transferring unit according to Embodiment 6.

As illustrated in FIG. 17, the drive transferring unit 130 differs from the drive transferring unit 120 (FIG. 15) in that a third transferring path 132 is provided instead of the third transferring path 122 (FIG. 15). The other configurations are similar to those of the drive transferring unit 120. Description of the second transferring path will be omitted.

The third transferring path 132 is a path for transferring the driving force F from the motor 51 to the third shaft section 37. Moreover, the third transferring path 132 is constituted by, for example, the drive gear 54, a first clutch 136, an idler gear 142, a second clutch 144, the idler gear 125, and the third clutch 126.

The first clutch 136, which is an example of the first switching section, is provided on the third transferring path 132 and is configured to be able to switch between enabling transfer of the driving force F and interrupting transfer of the driving force F. Specifically, the first clutch 136 is configured as an electromagnetic clutch and includes a main body section 137 and a clutch gear 138. The main body section 137 includes therein a coil (not illustrated) and generates a magnetic force when energized by the power supply of the printer 1 (FIG. 1). Moreover, the main body section 137 is integrated with the first shaft section 33. The end of the first shaft section 33 in the +Y direction is inserted into a through hole of the clutch gear 138.

When the first clutch 136 does not enable the main body section 137 to be energized, the clutch gear 138 does not move in conjunction with the main body section 137 and is rotatable alone about the first shaft section 33.

When the first clutch 136 enables the main body section 137 to be energized, the main body section 137 attracts the metal plate of the clutch gear 138 with a magnetic force, and the clutch gear 138 is thereby integrated with the main body section 137 and rotates upon rotation of the first shaft section 33.

The idler gear 142 is provided to be rotatable about a shaft section 141 extending in the Y direction. A tooth section of the idler gear 142 engages a tooth section of the clutch gear 138 and a tooth section of a clutch gear 146 described later.

The second clutch 144, which is an example of the second switching section, is provided on the third transferring path 132 and is configured to be able to switch between enabling transfer of the driving force F and interrupting transfer of the driving force F. Specifically, the second clutch 144 is configured as an electromagnetic clutch and includes a main body section 145 and the clutch gear 146. The main body section 145 includes therein a coil (not illustrated) and generates a magnetic force when energized by the power supply of the printer 1 (FIG. 1). Moreover, the main body section 145 is integrated with the second shaft section 35. The end of the second shaft section 35 in the +Y direction is inserted into a through hole of the clutch gear 146.

When the second clutch 144 does not enable the main body section 145 to be energized, the clutch gear 146 does not move in conjunction with the main body section 145 and is rotatable alone about the second shaft section 35.

When the second clutch 144 enables the main body section 145 to be energized, the main body section 145 attracts the metal plate of the clutch gear 146 with a magnetic force, and the clutch gear 146 is thereby integrated with the main body section 145 and rotates upon rotation of the second shaft section 35.

A tooth section of the clutch gear 146 engages the tooth section of the idler gear 142 and the tooth section of the idler gear 125. A tooth section of the clutch gear 128 engages the tooth section of the idler gear 125.

Here, for example, the number of teeth of the clutch gear 146 is 1.5 times the number of teeth of the clutch gear 138. The number of teeth of the clutch gear 128 is twice the number of teeth of the clutch gear 138.

Next, operation of the printer 1 and the drive transferring unit 130 according to Embodiment 6 will be described. Note that the same parts as those of Embodiments 1 to 5 will be given the same reference numerals, and description thereof will be omitted.

As illustrated in FIG. 17, the third clutch 126 is in the state of enabling transfer of the driving force F. The first clutch 136 and the second clutch 144 are in the state of interrupting transfer of the driving force F.

When the drive gear 54 rotates in the direction −R, the clutch gear 138 rotates in the direction +R on the first transferring path 52, but since transfer of the driving force F is interrupted, the main body section 137 does not rotate.

When the clutch gear 138 rotates in the direction +R, the clutch gear 146 rotates in the direction +R on the third transferring path 132, but since transfer of the driving force F is interrupted, the main body section 145 does not rotate. When the clutch gear 146 rotates in the direction +R, the clutch gear 128 rotates in the direction +R.

Here, since the third clutch 126 is in the state of enabling transfer of the driving force F, the third roller 38 rotates in the direction +R at the rotational speed V3, and the transferring gear 108 rotates in the direction +R. When the transferring section 102 transfers the driving force F, the transferring gear 78 and the transferring gear 74 rotate in the direction +R. Accordingly, the first roller 34 and the second roller 36 rotate in the direction +R at the rotational speed V3.

Figure 18:
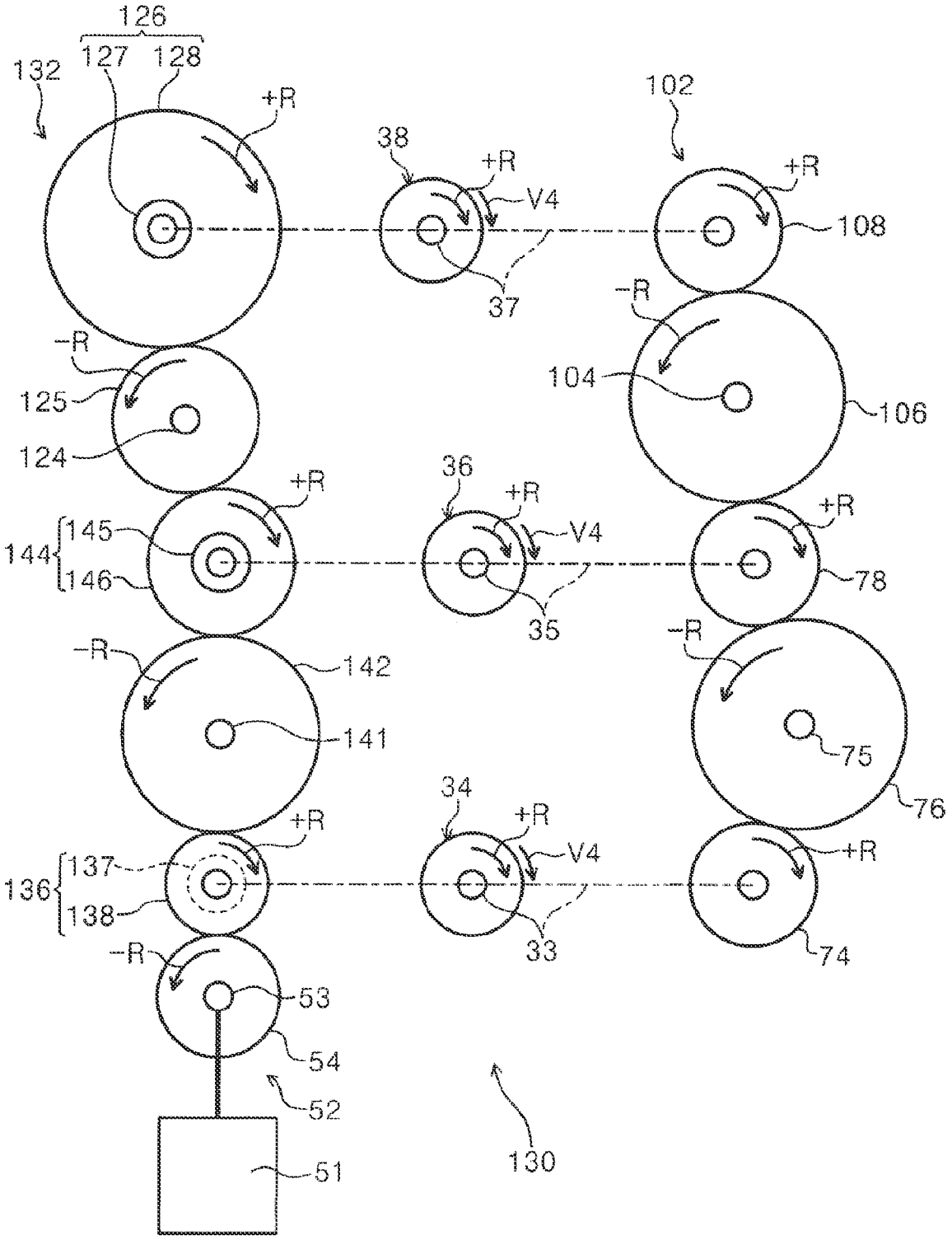
FIG. 18 is a schematic view illustrating rotational directions of the gears, the clutches, the first roller, the second roller, and the third roller during control in the drive transferring unit according to Embodiment 6.

As illustrated in FIG. 18, the first clutch 136 is in the state of enabling transfer of the driving force F. The second clutch 144 and the third clutch 126 are in the state of interrupting transfer of the driving force F.

When the drive gear 54 rotates in the direction −R, the clutch gear 138 rotates in the direction +R on the first transferring path 52, and the first roller 34 thus rotates in the direction +R at rotational speed V4. The rotational speed V4 is substantially twice the rotational speed V3 (FIG. 17).

When the transferring section 102 transfers the driving force F, the transferring gear 78 and the transferring gear 108 rotate in the direction +R. Accordingly, the second roller 36 and the third roller 38 rotate in the direction +R at the rotational speed V4.

Since the second clutch 144 and the third clutch 126 interrupt transfer of the driving force F, the main body section 145 and the clutch gear 146 do not interfere with each other, and the main body section 127 and the clutch gear 128 do not interfere with each other. In other words, neither the rotational speed of the clutch gear 146 nor the rotational speed of the clutch gear 128 does not affect the rotational speed V4 of each of the first roller 34, the second roller 36, and the third roller 38.

Note that, although not illustrated, when the second clutch 144 is in the state of enabling transfer of the driving force F and when the first clutch 136 and the third clutch 126 are in the state of interrupting transfer of the driving force F, the rotational speed of each of the first roller 34, the second roller 36, and the third roller 38 is substantially 1.5 times the rotational speed V3.

In this manner, according to the drive transferring unit 130, the rotational directions of the first roller 34, the second roller 36, and the third roller 38 are able to match, and the rotational speed is able to be switched between three stages of low speed, middle speed, and high speed.

Embodiment 7

Next, configurations of a drive transferring unit 150 and the printer 1 according to Embodiment 7, which are respective examples of the drive transferring device and the liquid ejecting apparatus according to the disclosure, will be specifically described. Note that the same parts as those of Embodiments 1 to 6 will be given the same reference numerals, and description of the parts and drawings will be omitted in some cases.

Figure 19:
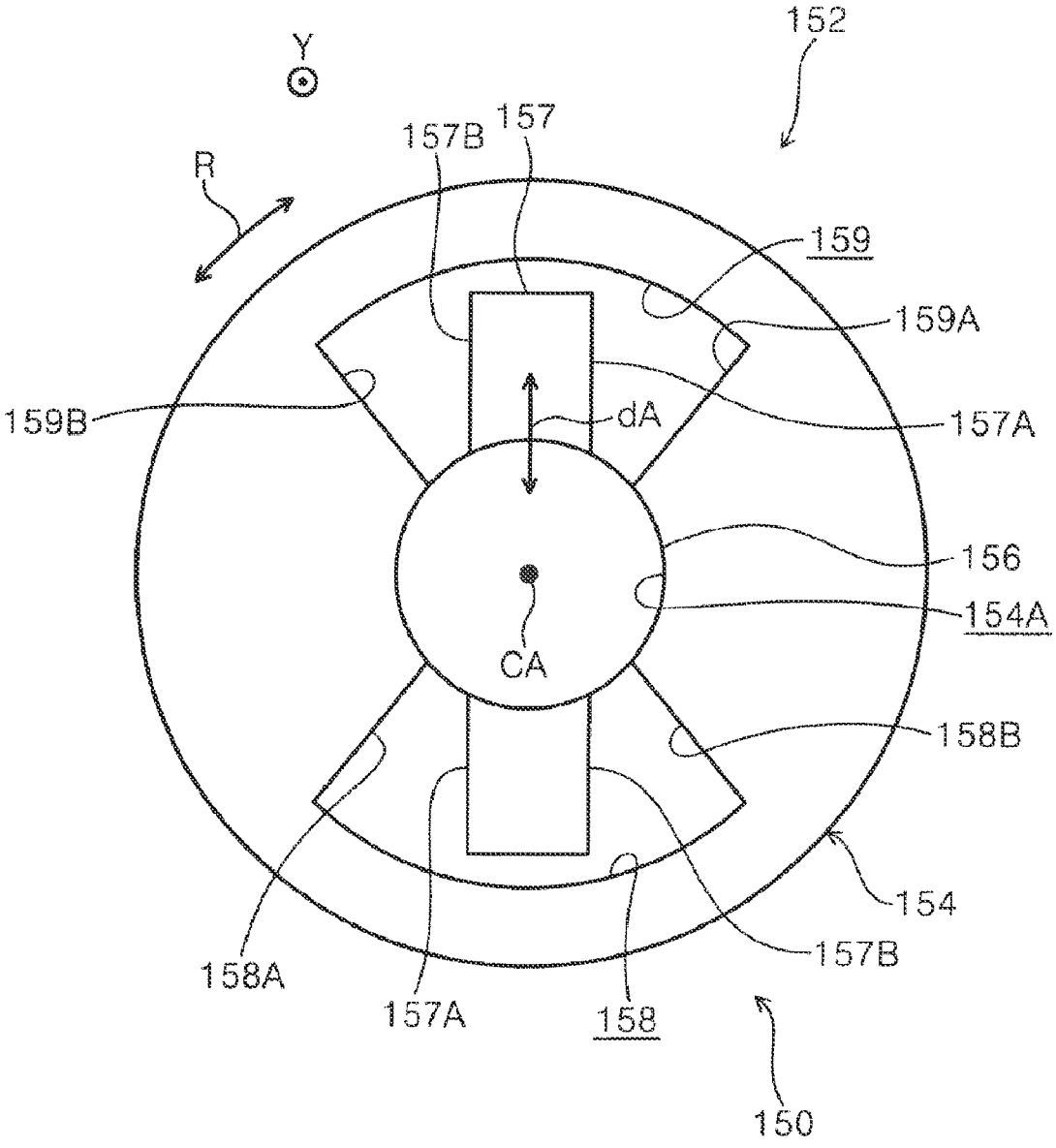
FIG. 19 is an enlarged front view of a first shaft section of a first roller and a transferring gear in a printer according to Embodiment 7.

As illustrated in FIG. 19, the drive transferring unit 150 differs from the drive transferring unit 50 of Embodiment 1 in that a first shaft section 156 is provided instead of the first shaft section 33, that a transferring section 152 is provided instead of the transferring section 72, and that a timing chart is changed.

The first shaft section 156 has a column shape whose central axis extends in the Y direction. Each end of the first shaft section 156 in the Y direction is rotatably supported by the aforementioned main body frame via a bearing. Note that a protrusion 157 that protrudes from the first shaft section 156 in the direction dA, which is a radial direction with respect to the center CA of the first shaft section 156, is formed in a portion of the −Y direction end of the first shaft section 156.

The protrusion 157 has, for example, a plate shape having a predetermined thickness in the direction R, which is the rotational direction of the first shaft section 156. The protrusion 157 is projected equally to one side and the other side of the first shaft section 156 in the direction dA. A side surface 157A is formed in one end of the protrusion 157 in the direction R. A side surface 157B is formed in the other end of the protrusion 157 in the direction R.

The transferring section 152 differs from the transferring section 72, for example, in that a transferring gear 154 is provided instead of the transferring gear 74. The other configurations are similar to those of the transferring section 72.

The transferring gear 154 is an example of the time-difference calculating section and is provided in the transferring section 152. The transferring gear 154 causes a time point at which the second shaft section 35 (FIG. 2) starts to rotate to be delayed relative to a time point at which the driving force F is transferred to the transferring section 152. Specifically, a through hole 154A which is circular when viewed in the Y direction and into which the first shaft section 156 is inserted is formed in the transferring gear 154. A hole section 158 and a hole section 159 each having a fan shape and arranged to be point-symmetrical with respect to the center CA when viewed in the Y direction are also formed in the transferring gear 154.

In each of the hole section 158 and the hole section 159, the central angle of the fan shape is substantially 90°. The protrusion 157 is accommodated in each of the hole section 158 and the hole section 159. A contact surface 158A capable of coming into contact with the corresponding side surface 157A is formed on one side of the hole section 158 in the direction R and a contact surface 159A capable of coming into contact with the corresponding side surface 157A is formed on one side of the hole section 159 in the direction R. A contact surface 158B capable of coming into contact with the corresponding side surface 157B is formed on the other side of the hole section 158 in the direction R and a contact surface 159B capable of coming into contact with the corresponding side surface 157B is formed on the other side of the hole section 159 in the direction R.

Here, a time difference is generated between a time point at which the first shaft section 156 starts to rotate and a time point at which each of the side surfaces 157A comes into contact with the corresponding one of the contact surface 158A and the contact surface 159A or a time point at which each of the side surfaces 157B comes into contact with the corresponding one of the contact surface 158B and the contact surface 159B.

Figure 20:
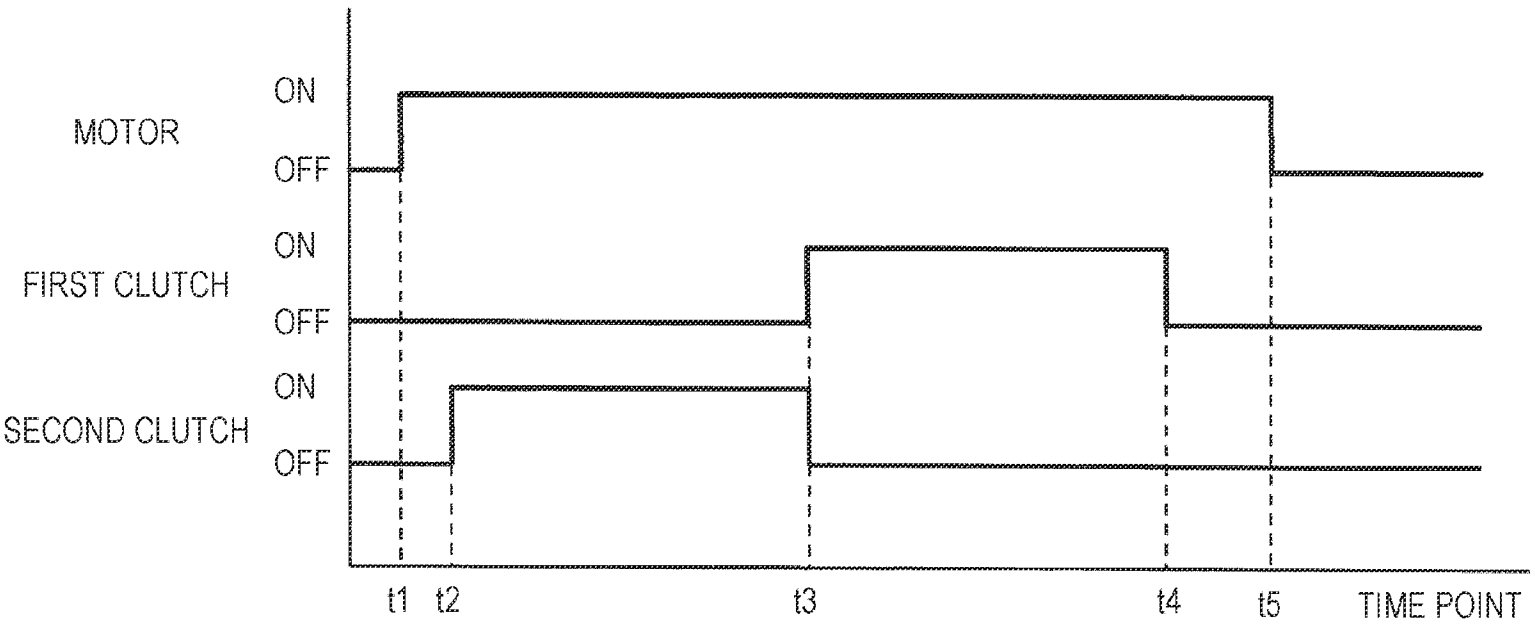
FIG. 20 is a timing chart illustrating on/off states of a motor, a first clutch, and a second clutch during control in the drive transferring unit according to Embodiment 7.

As illustrated in FIG. 20, in the drive transferring unit 150, for example, a time point at which the second clutch 65 is switched from the on state to the off state and a time point at which the first clutch 57 is switched from the off state to the on state are set to be at the same time point t3.

In other words, the control section 26 (FIG. 1) switches the control from one of the first control and the second control to the other during operation of the motor 51.

Next, operation of the printer 1 and the drive transferring unit 150 according to Embodiment 7 will be described. Note that the same parts as those of Embodiments 1 to 6 will be given the same reference numerals, and description thereof will be omitted.

According to the drive transferring unit 150, even when the control section 26 instantaneously switches the control from one of the first control and the second control to the other, the transferring gear 154 causes the time point at which the second shaft section 35 starts to rotate to be delayed relative to the time point at which the driving force F is transferred, thus making it possible to prevent one of the first clutch 57 and the second clutch 65 from transferring the driving force F in a state in which the other incompletely interrupts transfer of the driving force F.

Moreover, according to the drive transferring unit 150, even when the first clutch 57 and the second clutch 65 simultaneously perform the switching operation, the transferring gear 154 generates a time difference in transfer of the driving force F, rotation of the gears on the transferring path of the driving force F is hardly locked. In other words, it is not necessary to stop the operation of the motor 51 when the control is switched from one of the first control and the second control to the other, thus making it possible to suppress elongation of a time period in which the first roller 34 and the second roller 36 transport the medium M.

Although the printer 1 and the drive transferring unit 50, 80, 90, 100, 120, 130, or 150 according to each embodiment of the disclosure basically have the above-described configuration, it is of course possible, for example, to partially change or omit a configuration without departing from the scope of the disclosure of the present application.

Figure 21:
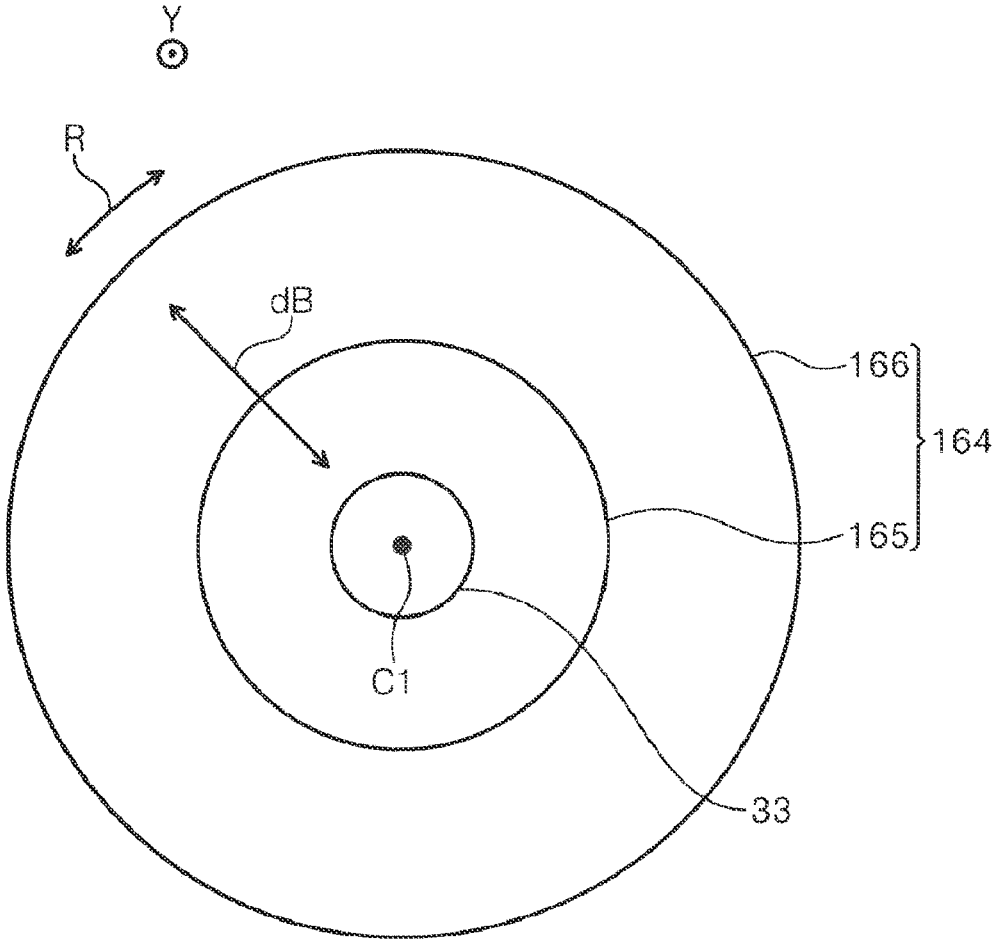
FIG. 21 is a front view of a first clutch of a drive transferring unit according to a modified example of Embodiment 1.

FIG. 21 illustrates a first clutch 164 as a modified example of the first clutch 57 (FIG. 2) of Embodiment 1.

The first clutch 164, which is an example of the first switching section, is provided on the first transferring path 52 (FIG. 2) and is configured to be able to switch between enabling transfer of the driving force F and interrupting transfer of the driving force F. Specifically, the first clutch 164 is configured as an electromagnetic clutch and includes a main body section 165 and a clutch gear 166. The first clutch 164 performs switching to either enabling transfer of the driving force F or interrupting transfer thereof in the direction dB, which is the radial direction of the first shaft section 33.

The main body section 165 is an example of the second rotating body. The main body section 165 has an annular shape when viewed in the Y direction. Further, the main body section 165 includes therein a coil (not illustrated) and generates a magnetic force when energized by the power supply of the printer 1. Moreover, the main body section 165 is integrated with the first shaft section 33.

The clutch gear 166 is an example of the first rotating body and has an annular shape when viewed in the Y direction. The inner diameter of the clutch gear 166 is slightly greater than the outer diameter of the main body section 165. The main body section 165 is arranged within the clutch gear 166. The clutch gear 166 includes a metal plate (not illustrated). A tooth section of the clutch gear 166 engages the tooth section of the drive gear 54 and the tooth section of the idler gear 62.

A first virtual line C1 denotes the common central axis of the main body section 165 and the clutch gear 166. The clutch gear 166 constitutes a portion of the second transferring path 56.

When the first clutch 164 does not enable the main body section 165 to be energized, the clutch gear 166 does not move in conjunction with the main body section 165 and is rotatable alone about the main body section 165.

When the first clutch 164 enables the main body section 165 to be energized, the main body section 165 attracts the metal plate of the clutch gear 166 with a magnetic force, and the clutch gear 166 is thereby integrated with the main body section 165 and rotates upon rotation of the first shaft section 33.

According to the configuration including the first clutch 164, the switching operation is performed in the direction dB of the first shaft section 33. In other words, no switching operation is performed in the axial direction of the first shaft section 33. Accordingly, it is not necessary to secure a space for the switching operation of the first clutch 164 in the axial direction of the first shaft section 33, thus making it possible to enhance flexibility in arranging the first clutch 164 in the Y direction.

Other Modified Examples

Embodiments 1 to 7 described above may be appropriately combined, and further, the following configuration may be added to or replaced with each of Embodiments 1 to 7 described above or a combination thereof.

The drive transferring unit 50, 80, 90, 100, 120, 130, or 150 is not limited to being applied to the printer 1 and may be applied to, for example, an electrophotographic recording apparatus, an image reading apparatus that reads an image of a document, or a post-processing apparatus that performs post-processing, such as punching or stapling, for a recorded medium.

Moreover, the printer 1 is not limited to have a configuration including the line head 30 and may have a configuration including a head of a serial type for ejecting ink while moving in the Y direction of the medium M in a state in which the head is mounted on a carriage.

The transferring gear 154 may cause a time point at which the first shaft section 33 starts to rotate to be delayed relative to a time point at which the driving force F is transferred to the transferring section 152.

The configuration of the second transferring path is not necessarily required to include the configuration of the first transferring path as long as the configuration of the second transferring path includes the drive gear 54. That is, the first transferring path and the second transferring path may be provided with the drive gear 54 as a branch point. Similarly, the configuration of the third transferring path is not necessarily required to include the configuration of the first transferring path and the configuration of the second transferring path as long as the configuration of the third transferring path includes the drive gear 54.

The first transferring path, the second transferring path, and the third transferring path may have an annular shape as a whole. Moreover, an annular transferring path may include the first transferring path, the second transferring path, the third transferring path, the first switching section, and the second switching section.

The drive source is not limited to one, such as the motor 51, for outputting the driving force F and may be a gear for receiving the driving force from another apparatus. That is, the drive source is not limited as long as the drive source is able to transfer the driving force to the first transferring path, the second transferring path, and the third transferring path. Moreover, the drive source is not limited to one, such as the motor 51, for driving the drive gear 54 in only one direction and may be a motor that causes the drive gear 54 to rotate in a forward or reverse direction.

The configuration is not limited to one in which the first switching section, the second switching section, and the third switching section are all configured as electromagnetic clutches and may be, for example, one in which two of the switching sections are electromagnetic clutches and the other is a torque limiter.

The number of idler gears may be another odd or even number as long as the rotational direction of each of the rollers described above does not change.

The first roller, the second roller, and the third roller are each not limited to be constituted by a single roller and may be each constituted by at least one roller. For example, the first roller, the second roller, and the third roller may each have two or more rollers. Moreover, a path on which the first roller, the second roller, and the third roller are used is not limited to a linear or curved transport path and may be a non-linear path such as a path for sheet folding.

The first switching section, the second switching section, the third switching section, and the transferring section may be collectively provided on one side with respect to the first roller, the second roller, and the third roller.

The first shaft section 33 and the first roller 34 may be integrated with each other or separate from each other, the second shaft section 35 and the second roller 36 may be integrated with each other or separate from each other, and the third shaft section 37 and the third roller 38 may be integrated with each other or separate from each other.

The medium M is not limited to a recording sheet, and a liquid such as ink is applicable. The medium M is not limited to one kind of medium. On a first medium used for transportation, such as a tray, a second medium used for recording, such as a CD, a DVD, or a blue-ray disc, may be mounted, or the second medium may be held between first media.

The first roller, the second roller, and the third roller are not limited to ones for directly transporting the medium M and may be, for example, ones for indirectly transporting the medium M by supporting an endless belt such that the endless belt is able to circulate or may be rollers for pressure-feeding liquid in a tube pump.

The switchback path is not limited to a path on which a medium transported in one direction is transported in reverse in an opposite direction. The switchback path includes a discharge path, on which a medium transported in one direction is transported in reversed to be processed and is then transported again in one direction.

The second switching section may be configured to perform switching to either enabling transfer of the driving force or interrupting transfer thereof in the radial direction of the first shaft section.

A combination of a configuration in which the first roller, the second roller, and the third roller rotate in forward and reverse directions and a configuration in which the rollers change the speed may be used.

The control section of the drive transferring device is not limited to one that is shared as in the control section 26 of the printer 1 and may be a dedicated control section.

What is claimed is:

1. A drive transferring device comprising:

a first roller that includes a first shaft section extending in one direction and transports a medium;

a second roller that is arranged at a position different from a position of the first roller, includes a second shaft section extending in the one direction, and transports the medium;

a first switching section that is provided on a first transferring path for transferring a driving force from a drive source to the first shaft section and that is configured to switch between enabling and interrupting transfer of the driving force;

a second switching section that is provided on a second transferring path for transferring the driving force from the drive source to the second shaft section and that is configured to switch between enabling and interrupting transfer of the driving force;

a transferring section that transfers the driving force from one of the first roller and the second roller to an other; and a control section that is configured to select between first control in which the first switching section enables transfer of the driving force and the second switching section interrupts transfer of the driving force and second control in which the second switching section enables transfer of the driving force and the first switching section interrupts transfer of the driving force.

2. The drive transferring device according to claim 1, wherein the transferring section transfers the driving force from the first transferring path to the second transferring path in the first control and transfers the driving force from the second transferring path to the first transferring path in the second control.

3. The drive transferring device according to claim 1, wherein the transferring section transfers the driving force from the first shaft section to the second shaft section in the first control and transfers the driving force from the second shaft section to the first shaft section in the second control.

4. The drive transferring device according to claim 1, wherein the transferring section transfers the driving force such that the first shaft section starts to rotate and the second shaft section then starts to rotate in the first control, and transfers the driving force such that the second shaft section starts to rotate and the first shaft section then starts to rotate in the second control.

5. The drive transferring device according to claim 1, wherein the first switching section includes a first rotating body and a second rotating body that have a common central axis corresponding to a first virtual line extending in the one direction, and the second switching section includes a third rotating body and a fourth rotating body that have a common central axis corresponding to a second virtual line extending in the one direction.

6. The drive transferring device according to claim 5, wherein the first rotating body constitutes a portion of the second transferring path in the second control.

7. The drive transferring device according to claim 1, wherein when control is switched from one of the first control and the second control to an other, the first roller and the second roller change a rotational direction.

8. The drive transferring device according to claim 1, wherein when control is switched from one of the first control and the second control to an other, the first roller and the second roller change rotational speed.

9. The drive transferring device according to claim 1, wherein the transferring section enables the first roller and the second roller to rotate in an identical direction.

10. The drive transferring device according to claim 1, wherein the transferring section enables the first roller and the second roller to rotate in different directions.

11. The drive transferring device according to claim 1, wherein the first switching section and the second switching section are located on one side with respect to the first roller and the second roller in the one direction, and the transferring section is located on an other side with respect to the first roller and the second roller in the one direction.

12. The drive transferring device according to claim 1, wherein the control section causes the first switching section and the second switching section to interrupt transfer of the driving force between the first control and the second control.

13. The drive transferring device according to claim 1, wherein the transferring section includes a time-difference calculating section that causes a time point at which the first shaft section or the second shaft section starts to rotate to be delayed relative to a time point at which the driving force is transferred.

14. The drive transferring device according to claim 1, wherein the control section switches control from one of the first control and the second control to an other during operation of the drive source.

15. The drive transferring device according to claim 1, wherein the drive source transfers the driving force to the first transferring path and the second transferring path via a rotating section that rotates in only one direction.

16. The drive transferring device according to claim 1, wherein the first roller and the second roller are provided on a switchback path for switching a transport direction of the medium.

17. The drive transferring device according to claim 1, wherein the first switching section performs switching to either enabling transfer of the driving force or interrupting transfer of the driving force in a radial direction of the first shaft section.

18. The drive transferring device according to claim 1, wherein the first switching section is arranged on the first shaft section.

19. The drive transferring device according to claim 1, further comprising a third roller that includes a third shaft section extending in the one direction and receives the driving force from the transferring section to transport the medium.

20. A liquid ejecting apparatus comprising:

a recording section that performs recording by ejecting a liquid onto the medium; and the drive transferring device according to claim 1 that transfers the driving force to the first roller and the second roller to transport the medium subjected to recording by the recording section.

* * * * *